US005340155A

United States Patent [19]

Podosek

[11] Patent Number: 5,340,155

[45] Date of Patent: Aug. 23, 1994

[54] CASE-BOUND HOT-MELT BINDING SYSTEM

[75] Inventor: Edward Podosek, Wilbraham, Mass.

[73] Assignee: Avery Dennison Corporation, Pasadena, Calif.

[21] Appl. No.: 979,206

[22] Filed: Nov. 20, 1992

[51] Int. Cl.[5] ..... B42C 9/00; B42D 3/00

[52] U.S. Cl. ..... 281/29; 281/21.1; 281/36; 412/5; 412/8; 412/21; 412/900

[58] Field of Search ..... 412/4, 5, 8, 19, 20, 412/21, 900; 281/21.1, 29, 36

[56] References Cited

U.S. PATENT DOCUMENTS

| | | | |
|---|---|---|---|
| 1,844,516 | 2/1932 | Meyer et al. | 412/8 |
| 3,292,951 | 12/1966 | Schoenberger | 412/5 X |
| 3,925,126 | 12/1975 | Leatherman et al. | 412/5 X |
| 4,091,487 | 5/1978 | Axelrod | 412/5 |
| 4,184,218 | 1/1980 | Hawkes | 412/8 |
| 4,289,330 | 9/1981 | Wiermanski | 412/900 X |
| 4,527,814 | 7/1985 | Carter et al. | 412/5 X |
| 5,013,200 | 5/1991 | Hunder et al. | 412/8 X |
| 5,078,563 | 1/1992 | Lolli | 412/8 |

*Primary Examiner*—Mark Rosenbaum
*Assistant Examiner*—S. Thomas Hughes
*Attorney, Agent, or Firm*—Kriegsman & Kriegsman

[57] ABSTRACT

This invention is a binding case for use in an office-type, small-volume, binding operation employing the hot-melt adhesive binding method. The invention is a design and method which cause the excess hot-melt adhesive which expresses laterally from each side of the adhesive strip to be directed in such a way that the excess adhesive does not adhesively bind the book block to the front or rear cover and does not bring about the destruction in appearance or functionality which such undesirable binding would cause. The invention involves a diverting element which forms a channel for the excess adhesive so that the excess adhesive does not bind the book block directly or functionally to the covers.

5 Claims, 23 Drawing Sheets

CASE-BOUND HOT-MELT BINDING SYSTEM

FIELD OF INVENTION

This invention is a hot-melt binding system for use in a case-bound binding process.

BACKGROUND OF THE INVENTION

In the conventional hard-bound cover book binding process, the outside cover is called the "case". It is ordinarily formed of two pieces of rigid chip board, glued to a covering material with a separation between them, called the spine, equal in width to the approximate thickness of the book that is to be bound within the covers. The basic group of pages of a case-bound book are collectively referred to as a "signature". Each of the signatures to be bound in the book are typically stitched to a fabric inner spine which holds the signatures together and forms the signatures into a book-like structure. All of the pages to be bound in a book are collectively called the "book block" or the "insides", and may include one or more signatures or may be formed of individual page-sized sheets. The stitched book block is then attached to the case by "end papers" or fly leaves which are, in turn, formed of a sheet of paper folded in half so that the folded size, now two pages, is approximately equal to the size of one page of the book block.

One half of each of the end leaves is glued to one of the inside covers of the case (from and back covers), and the other half of the end leaves is glued to the first page of the book block and the last page of the book block, forming a two page fly leaf. The end result is two single sheets of paper folded in half, one glued to the inside of the from cover of the case and to the first page of the book block and the other glued to the inside of the back cover of the case and to the last page of the book block. This technique is the standard for high quality commercial production of all types of hard bound, generally high-quality, books.

One of the difficulties with the traditional processes necessary to achieve the high-quality look of case-bound or other hard-bound bindings for books is that the stitching and assembly of the parts of the product require large and very expensive specialized equipment operating in large specially-designed facilities and operated by highly skilled technicians. It is virtually impossible to carry out the traditional case-bound binding process in a small office and on a small scale. Binding equipment and systems have recently become available for the production of small quantities of catalogs, brochures and other reports in a typical office environment. This special aspect of book binding technology is herein called "desktop binding". The term "desktop binding" is used as a term of art to describe a binding operation adapted to be carded out in an office environment (as opposed to a commercial bindery environment). The "desktop binding" operation involves binding less than commercial quantities of books, and involves binding individual sheets of paper rather than folded, multi-leaf folios. It typically seeks speed, convenience, low-capital investment and quality over volume and cost efficiency. The system usually is based on a pre-formed flexible binder cover with a strip of hot-melt adhesive on the inside spine. The pages to be bound are placed with their edge against the hot melt adhesive and the binder spine is placed in a special piece of equipment which heats up the hot melt equipment and causes the sheets to be bound into the cover. The fact that the pages and cover are frequently bound together at the spine in a somewhat inflexible manner is acceptable because the covers themselves are quite flexible.

More specifically, the products available on the market have cases made from either one piece of material with creases to create the hinge and a strip of hot-melt adhesive layered in place on the inside of the spine between the hinges of the cover or creases. Some covers (cases) may have three pieces of chip board covered with a binding material, with space between the spine and each of the front and back covers to create a hinge. The inside of this cover would be lined with a plain type of paper which would hide the edges of the covered material as it was turned over the edge of the clipboard stiffener, and, in effect, this approach would duplicate the appearance of the typical commercial case-made book. This cover would also have a strip or ribbon of hot-melt adhesive applied to the spine between the creases or hinges. Such a case is shown in perspective in FIG. 1. Such a product would have a front cover 12, a rear cover 13, and a spine 14. A liner 21 would be adhesively bound to the inside of the front cover 12 and the inside of the rear cover 13 and extend across the spine groove 15 to form a bridge across the spine groove 15. 0n the inside surface of this bridge 20 would be a layer of hot-melt adhesive 30. Liner 21 could be replaced by a tape which forms the bridge.

A diagrammatic view of the hot-melt binding method is shown in FIG. 2. The book block 11 of pages is placed in the case 10 with the edge of the book block abutting the adhesive strip 16 which is adjacent the spine 14. The resulting combination is placed in the binding equipment 31 which is made up of a clamping assembly 32 including an anvil 33 and a clamp 34, and a heating element 35. Once the unbound assembly is placed in the clamping assembly, the heating element melts the adhesive and binds the pages into the case.

FIG. 3 shows an end view of the spine of the prior art construction. The case 10 has the front cover 12, the rear cover 13, and the spine 14. The liner 21 is adhesively bonded to the covers by adhesive layers 16. The liner 21 bridges across the spine 14, to form an open-ended spine groove 15 or tunnel., and carries, on its inner surface, the hot-melt adhesive 30.

In FIG. 4, the case is shown with the book block 11 standing on the adhesive 30.

In FIG. 5, the case is shown with the front cover 12 and the rear cover 13 folded up against the book block.

In FIG. 6, the hot-melt adhesive is shown after the melting process has been carried out. It can be seen that excess adhesive has expressed outwardly from the ends of the hot-melt strip 30 and has been carried upward between the first page of the book block 11 and the liner 21, on one side, and the last page of the book block 11 and the liner 12, on the other side.

In FIG. 7 it can been seen that when the rigid front cover 12 and rear cover 13 are folded downward in the open-book position, the excess adhesive must either undesireably bond the first (and last) page and the liner together so that the cover cannot lie flat, or, eventually, must separate from one or the other of the surfaces to which the excess adhesive has become fixed. The result is that either a page of the book block is torn as shown as element 23 or the liner 21 is torn as shown as 24. In either case, the result is an unsightly and therefore unacceptable binding product which does not provide the high quality appearance which is necessary in order for the case-bound process to be effectively carried out in a hot-melt technology.

These and other difficulties experienced with the prior art devices have been obviated in a novel manner by the present invention.

It is therefore, an outstanding object of the invention to provide a case-bound binding system which can be carried out in a typical office environment.

Another object of the invention is the provision of a case-bound binding process in which the excess hot-melt adhesive does not create unsightly destruction of the parts of the product nor does it inappropriately limit the range of motion (especially, the ability to lie fiat) of the product.

With these and other objects in view, as will be apparent to those skilled in the art, the invention resides in the combination of parts set forth in the specification and covered by the claims appended hereto.

SUMMARY OF THE INVENTION

This invention is a binding case for use in an office-type small-volume, binding operation employing the hot-melt adhesive binding method. The invention is designed to be used with any one of several Hot Melt Binding machines currently available and in commercial use, as well as similar systems to be developed. The invention is a design and method which cause the excess hot-melt adhesive, which expresses laterally from each side of the adhesive strip, to be directed in such a way that the excess adhesive does not adhesively bind the book block to the front or rear cover and does not bring about the destruction in appearance or functionality which such undesirable binding would cause. The invention involves a diverting element which forms a channel for the excess adhesive so that the excess adhesive does not bind the book block directly or functionally to the covers.

This specification sets out five embodiments of the invention.

The first and second embodiments employ traditional folded end leaves which are positioned so that the end leaf fold acts as a diverting element. In the first embodiment, the fold diverts the excess to a channel between the end leaf and the book block and the second embodiment, the diverter directs the excess adhesive to a channel between the end leaf and the cover.

In the third, fourth and fifth embodiments, a diverter surrounds the adhesive strip and forms a diverting channel between the diverting element and the book block. In the third embodiment, a laminated structure is provided for an extremely strong structure. In the fourth embodiment, a narrow diverting strip surrounds the excess adhesive. In the fifth embodiment, a page-size diverting element takes on the appearance of the traditional end leaf.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

The following material sets out a description of five embodiments of the present invention. Each embodiment resolves the problem, present in the prior art, of excess hot-melt adhesive bonding the book block to the covers. In each case, the solution involves providing a diverting element which forms a diversion channel adjacent the sides of the hot-melt adhesive strip. The channel diverts away the excess adhesive in a manner which avoids the problem of bonding the book block to the covers. Each of the five embodiments is different not only in the details of its structure but also in the strength which could be reasonably expected, the aesthetic aspects and the difficulty of manufacture. Thus, the user would select from among the five embodiments that embodiment which is most appropriate for his or her specific application.

Figure 1:
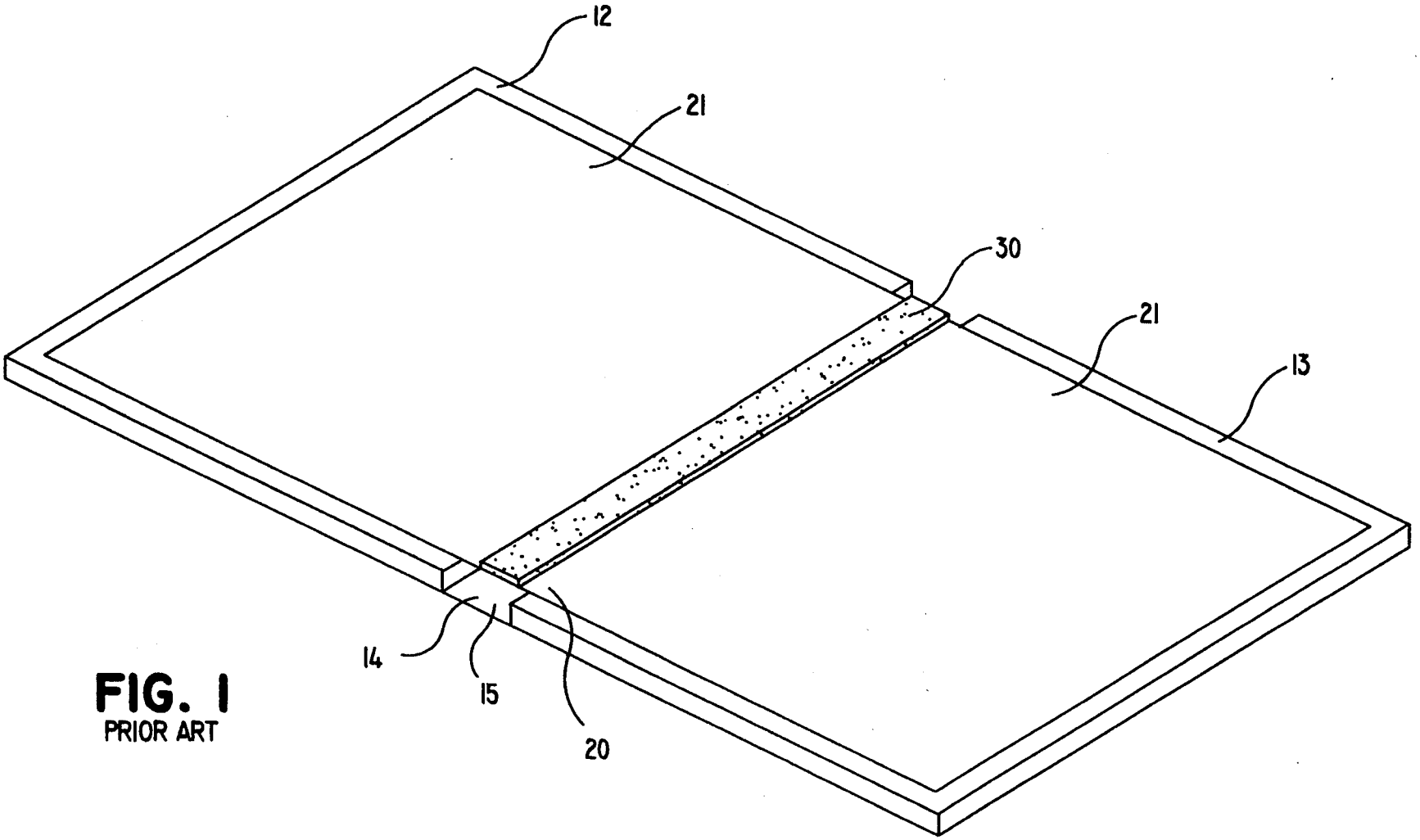
FIG. 1 PRIOR ART
FIG. 1 is a perspective view of a prior art structure.

The first embodiment of the present invention is shown in FIGS. 8 through 14. In essence, it is exactly like the prior art case 10 shown in FIG. 1 except that the case also includes 2 diverting elements 123 and 124 which are very similar in appearance to the end leaves (also called end papers or fly leaves) which are traditionally used in case-binding of books. Each diverting element is formed of a sheet of paper folded in half to form two page-size sheets. In the manufacture of the case, the outside sheet of each of the diverting elements is adhesively bonded to the liner 121 with the fold of each diverting element 123 and 124 adjacent the hot-melt strip 130. It is important to recognize the hot-melt strip 130 is bonded to and supported by the liner 121, in the normal manner associated with hot-melt binding systems. The diverting elements 123 and 124 do not carry out the traditional functions of end papers in the case-bound binding process but rather simply function to divert excess hot melt adhesive in a manner which avoids the problem of the binding of the covers to the book block.

Figure 9:
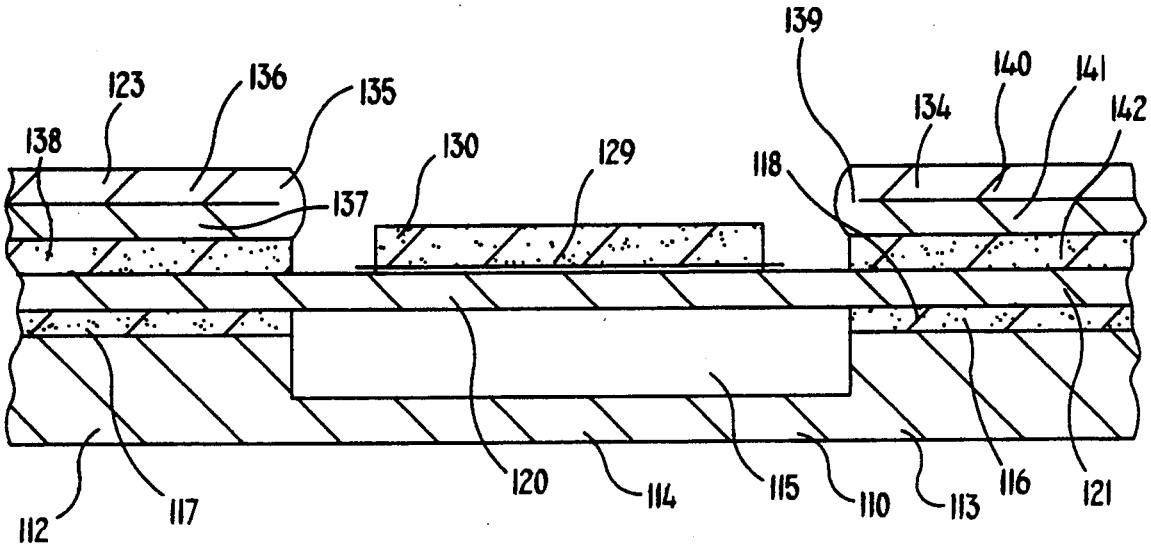
FIG. 9 is a diagrammatic end view of the first embodiment of the present invention.

Referring FIG. 9, the sectional view of the case 110 is shown with the front cover 112, the rear cover 113 and the spine 114. The liner 121 is adhesively bound by adhesive layer 116 to the inside surfaces 117 and 118 of the front and rear covers respectively. The liner 121 forms a bridge 120 across the spine groove 115. The hot-melt adhesive strip 130 is adhesively bonded to the inside surface 129 of the liner 121. Diverting element 123 has a fold 135, an inner page 136 and an outer page 137 is adhesively bonded by adhesive layer 138 to the portion of liner 121 which is bonded to the inside surface 117 of the front cover 112. It is so bonded that the fold 135 is adjacent one side of the hot-melt strip 130. The diverting element 124 has a fold 139, an inner page 140 and an outer page 141. The outer page 141 is adhesively bonded by adhesive layer 142 to the portion of the liner 121 which is bonded to the inside surface 118 of the rear cover 113. The diverting element 124 is so bonded that the fold 139 is adjacent one side of the hot-melt adhesive strip 130.

Figure 10:
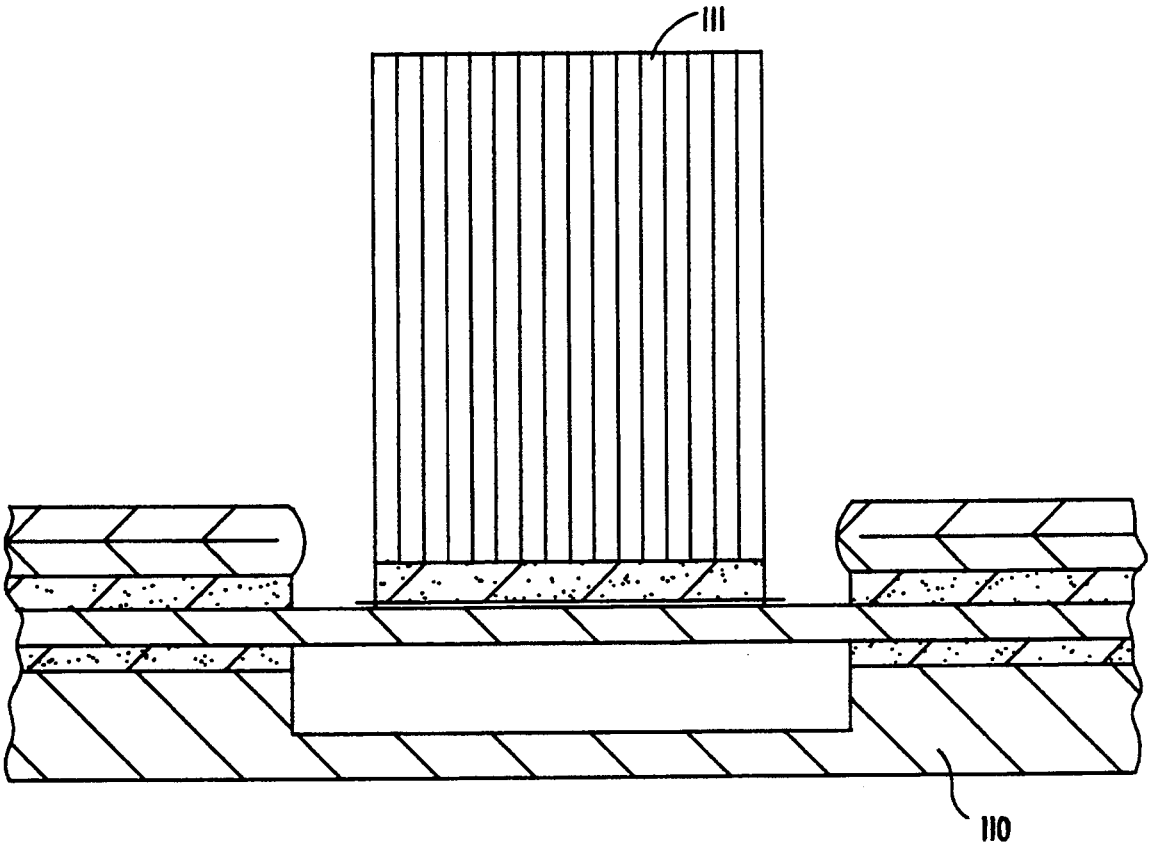
FIG. 10 is diagrammatic end view of the second step in the first embodiment of the present invention.

FIG. 10 shows the case 110 with the book block 111 stacked on the hot-melt strip 130.

Figure 11:
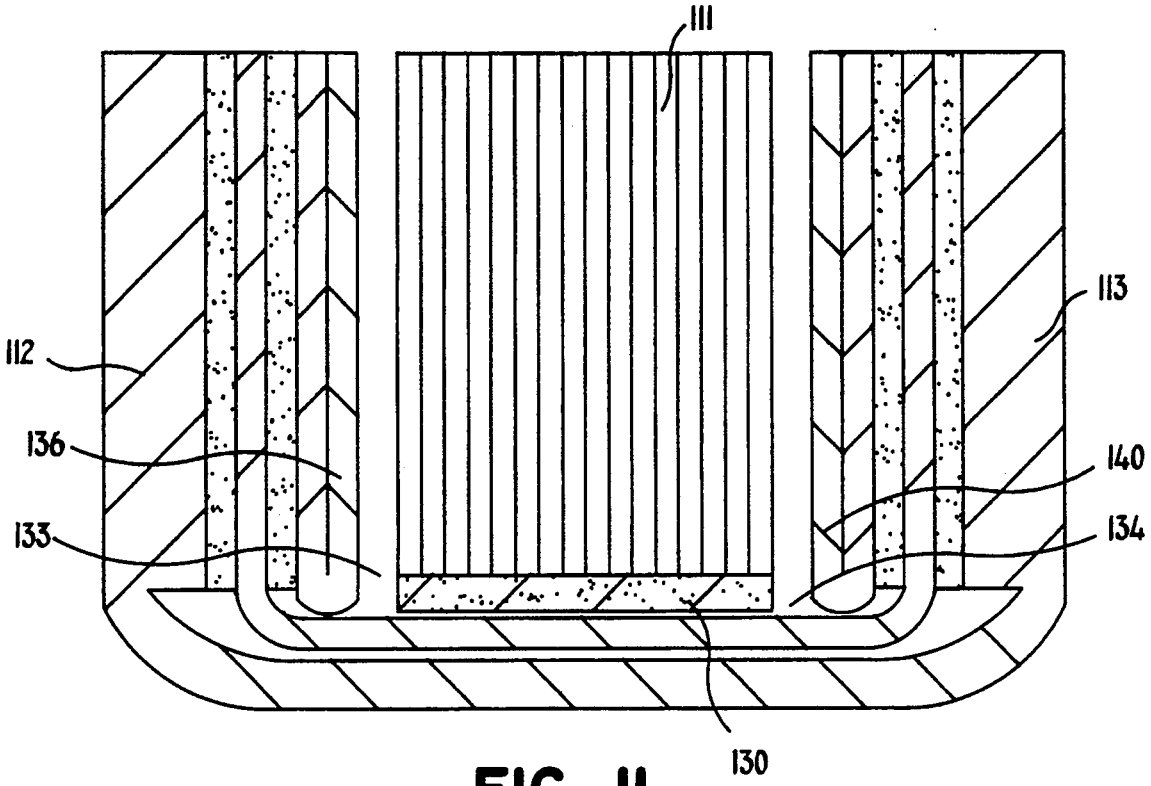
FIG. 11 is a digrammatic view of the third step of the first embodiment of the present invention.

FIG. 11 shows the front cover 112 and the rear cover 113 folded against the book block 111 in preparation for the hot-melt bonding operation. The hot-melt strip 130 is not yet melted but it can be seen that channels 133 and 134 are formed between the inner page 136 and the book block 111 and the inner page 140 and the book block 111.

Figure 12:
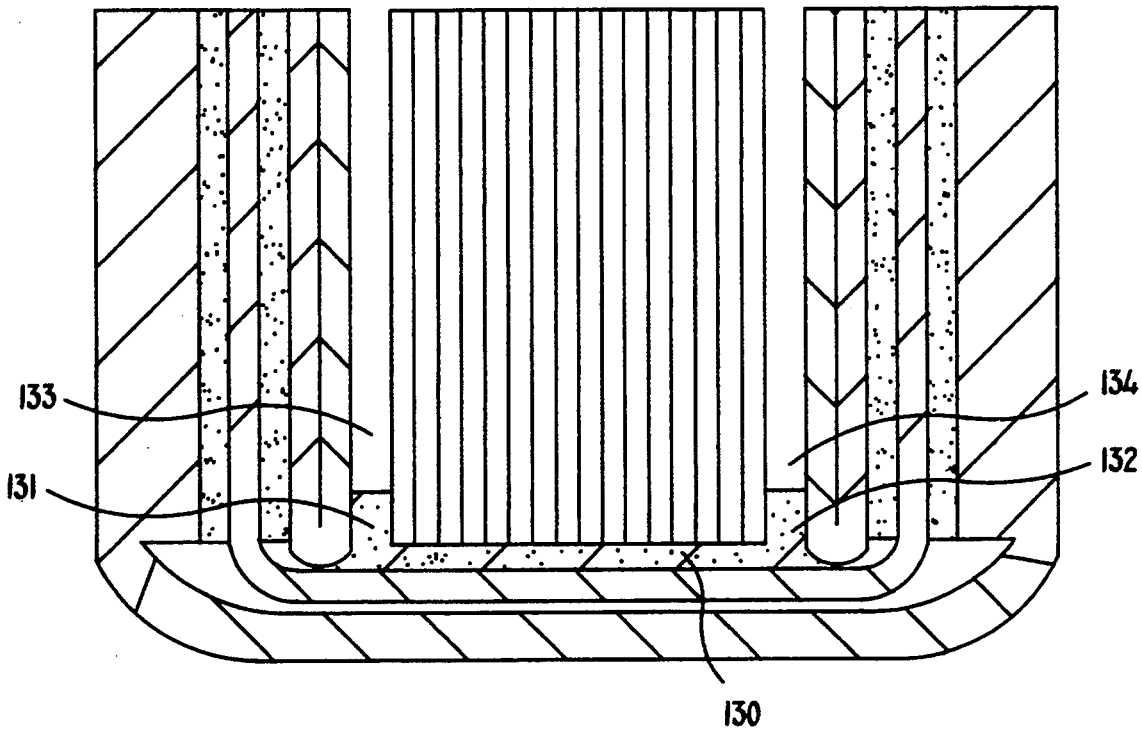
FIG. 12 is a diagrammatic view of the fourth step of the first embodiment of the present invention.

FIG. 12 shows the result of the hot-melt bonding process in which the hot-melt strip 130 has melted and excess hot melt adhesive has expressed sideways as portions 131 and 132 in the channels 133 and 134.

Figure 13:
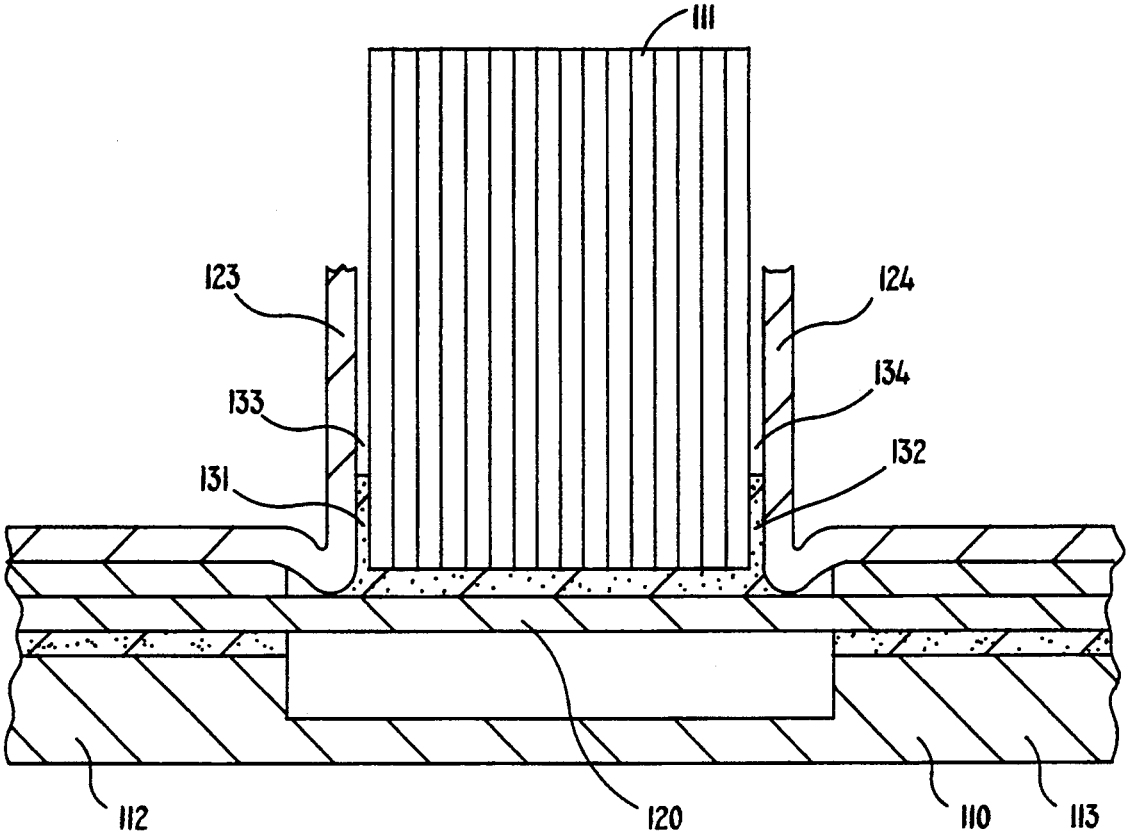
FIG. 13 is a diagrammatic view of the fifth step of the first embodiment of the present invention.

FIG. 13 shows the product after the hot-melt binding process with the covers 112 and 113 spread sideways. It should be noted that the excess adhesive portions 131 and 132 have been diverted into channels 133 and 134 so that they do not bond the book block directly to the covers nor do they interfere in any way with the hinge action of the covers. In essence the diverting elements 123 and 124 have the appearance of traditional end papers although it can be seen that they do not function in the traditional way of end papers in that it is the bridge 120 which actually holds the book block 111 to the case 110.

Figure 14:
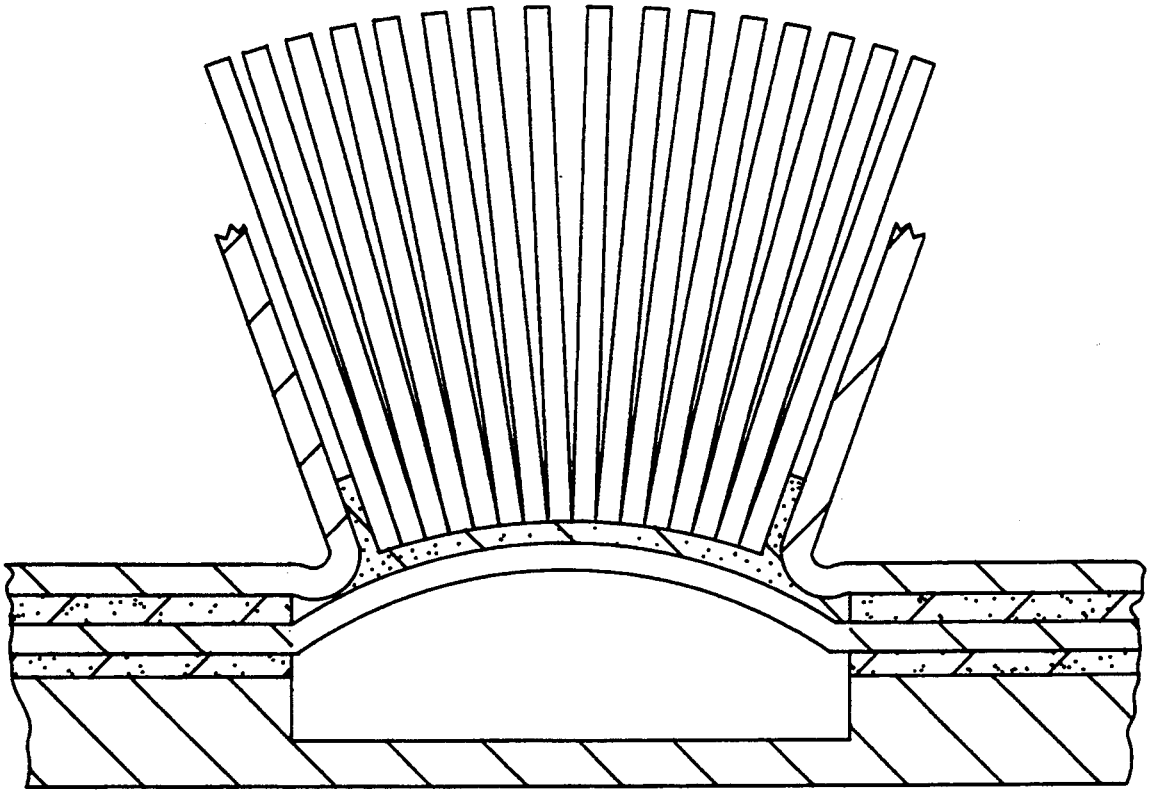
FIG. 14 is a diagrammatic view of the sixth step of the first embodiment of the present invention.

FIG. 14 shows the pages of the book block fanned to demonstrate the flexibility of this construction.

Figure 8:
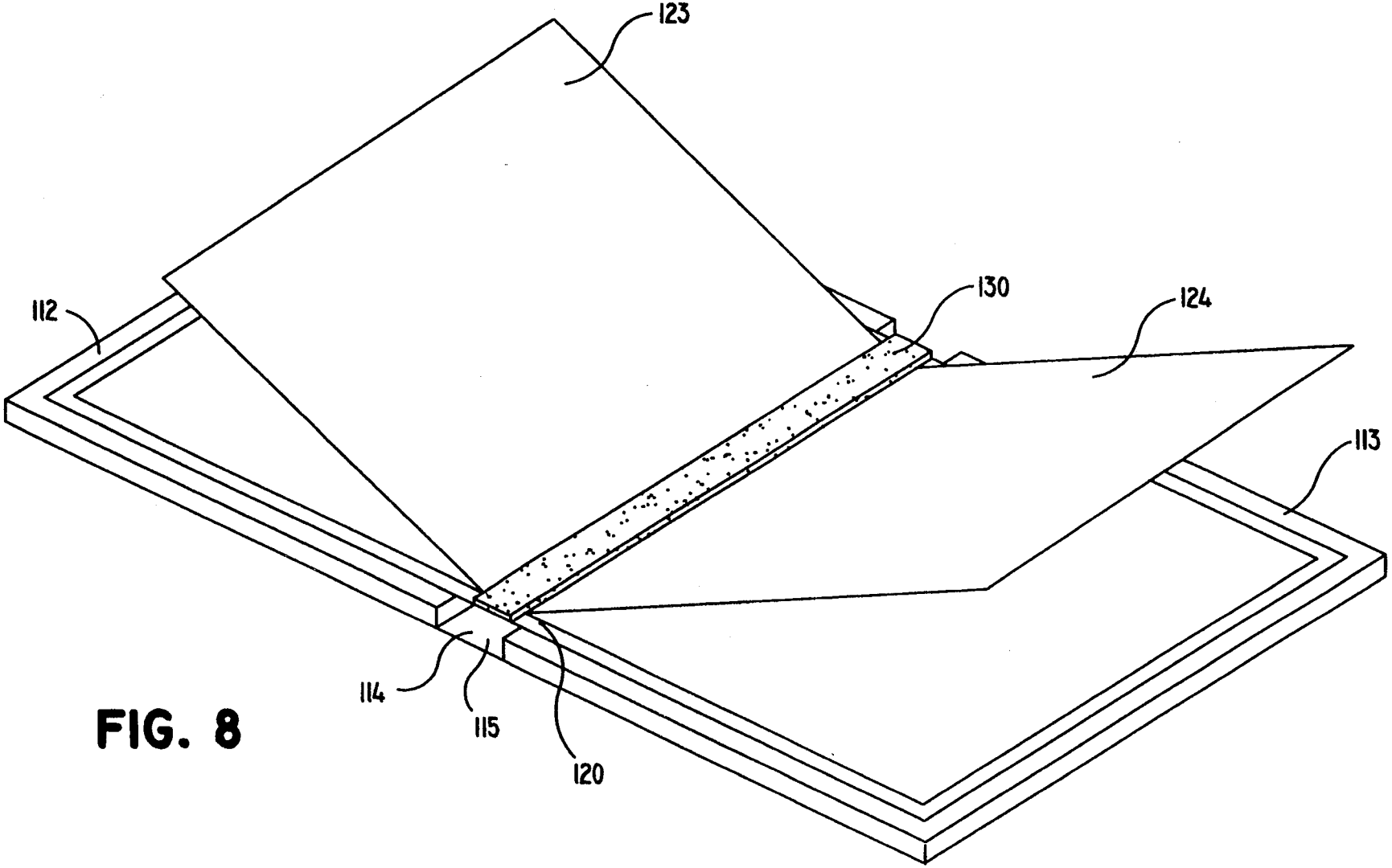
FIG. 8 is a diagrammatic view of the first and second embodiments of devices which embody the principles of the present invention.
Figure 15:
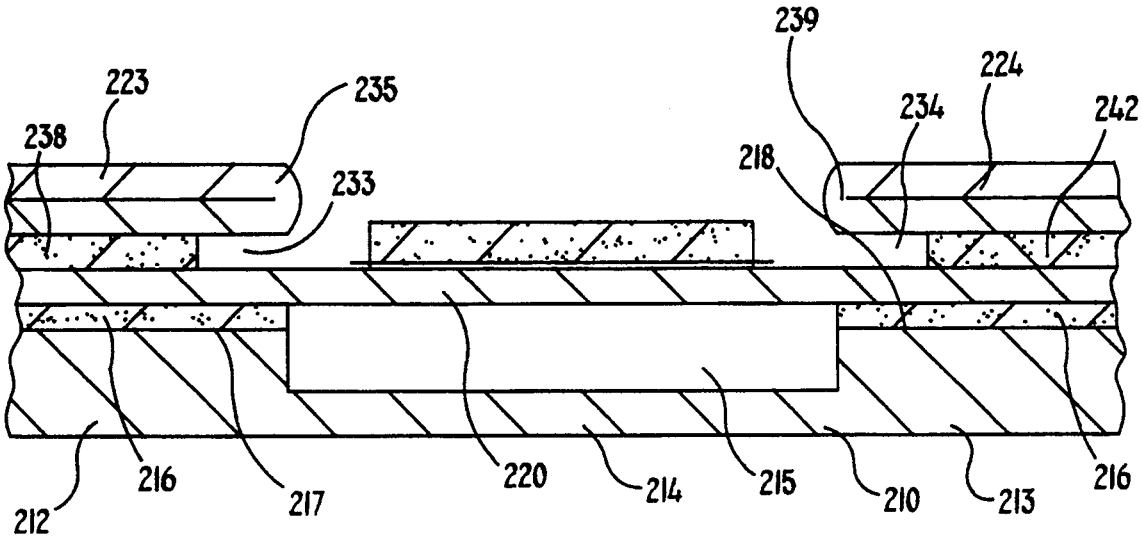
FIG. 15 is a diagrammatic view of the first step in the second embodiment of the present invention.

The second embodiment of this invention has an outer appearance which would look very similar to the first embodiment as shown in FIG. 8. The unique structure of the second embodiment is shown in FIGS. 15 through 20. Referring to FIG. 15, it will be noted that the feature which distinguishes the second embodiment from the first embodiment is the formation of the diverting channels 233 and 234 in the original case 210. The second embodiment is similar to the first embodiment in that it has a from cover 212, a rear cover 213, an adhesive layer 216 which holds a liner on the inside surfaces 217 and 218 of the covers, and forms a bridge 120 across the spine groove 215 over the spine 214. As mentioned above, the distinction is that the adhesive layers 238 and 242 are recessed under the fold 235 and 239 of the diverting elements 223 and 224 to form the channels 233 and 234.

Figure 16:
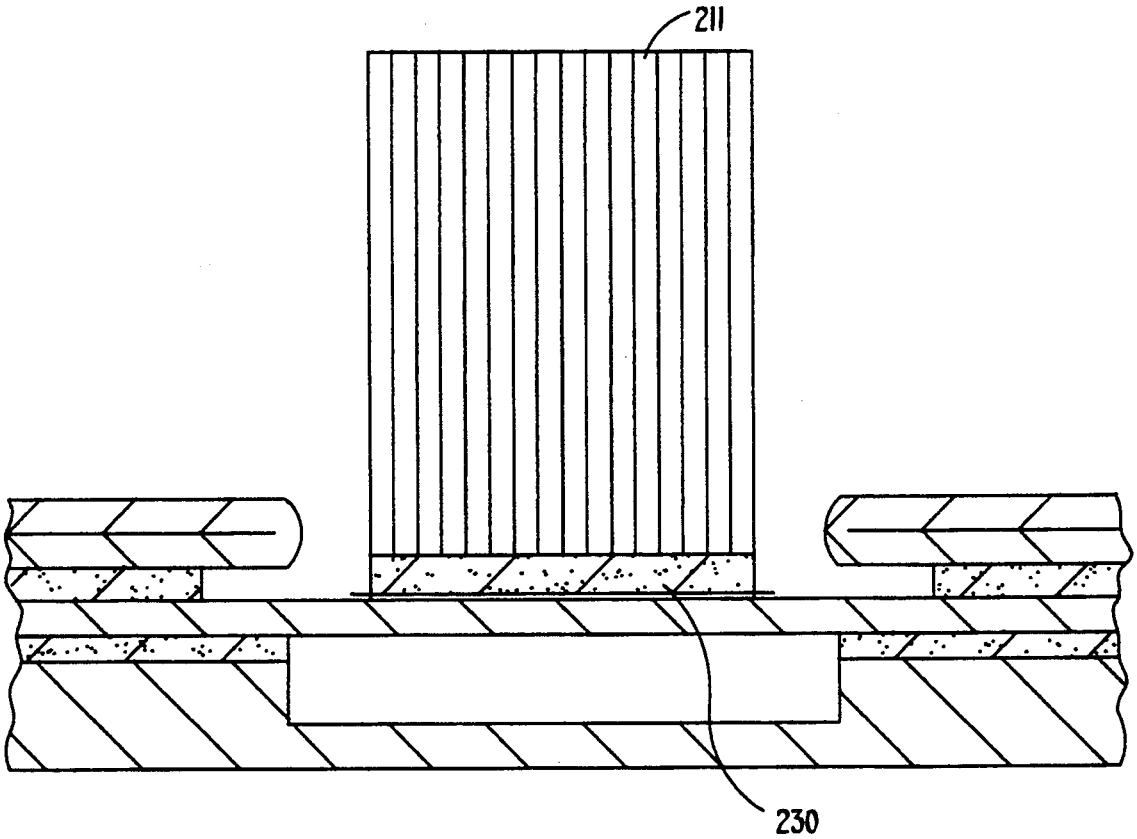
FIG. 16 is a diagrammatic view of the second step in the second embodiment of the present invention.

FIG. 16 shows the book block 211 stacked on the hot melt strip 230.

Figure 17:
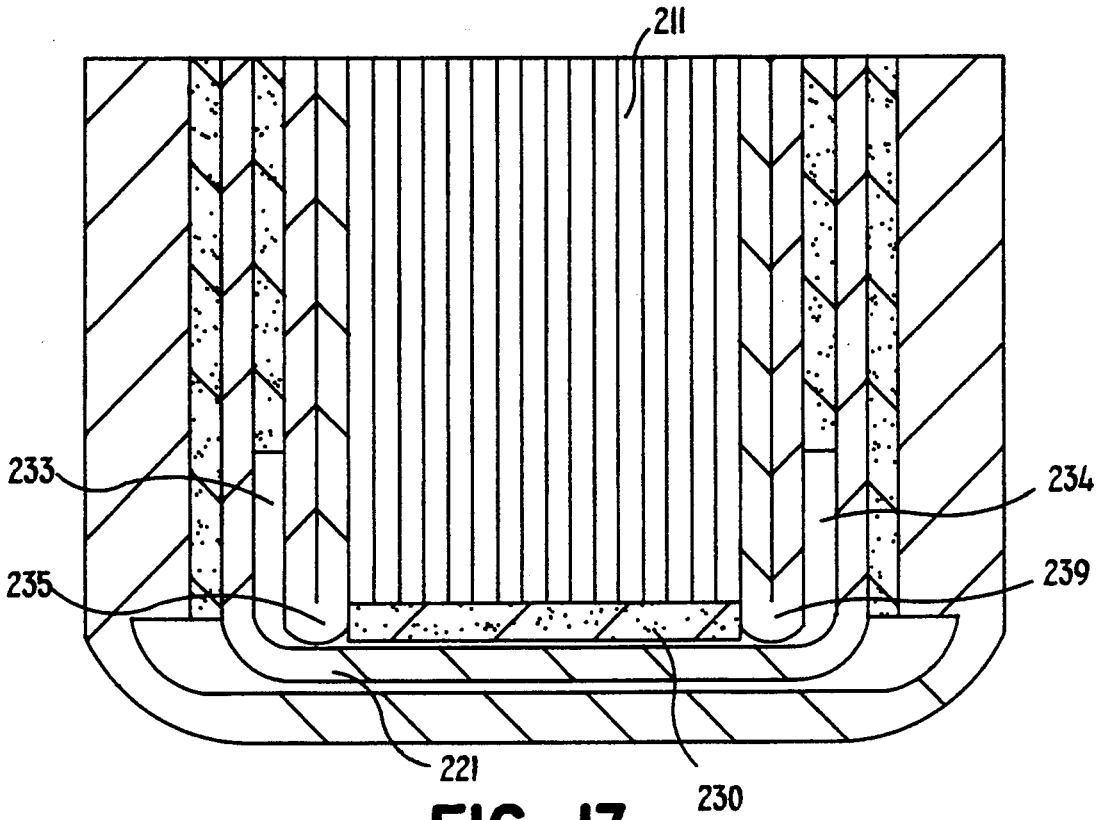
FIG. 17 is a diagrammatic view of the third step in the second embodiment of the present invention.

FIG. 17 shows the case ready to be hot-melt bound. It is significant to note that the case is so designed that the folds 23S and 239 are not pressed against the liner 221. Rather, the folds are set back to allow a path between the hot-melt strip 230 and the channels 233 and 234.

Figure 18:
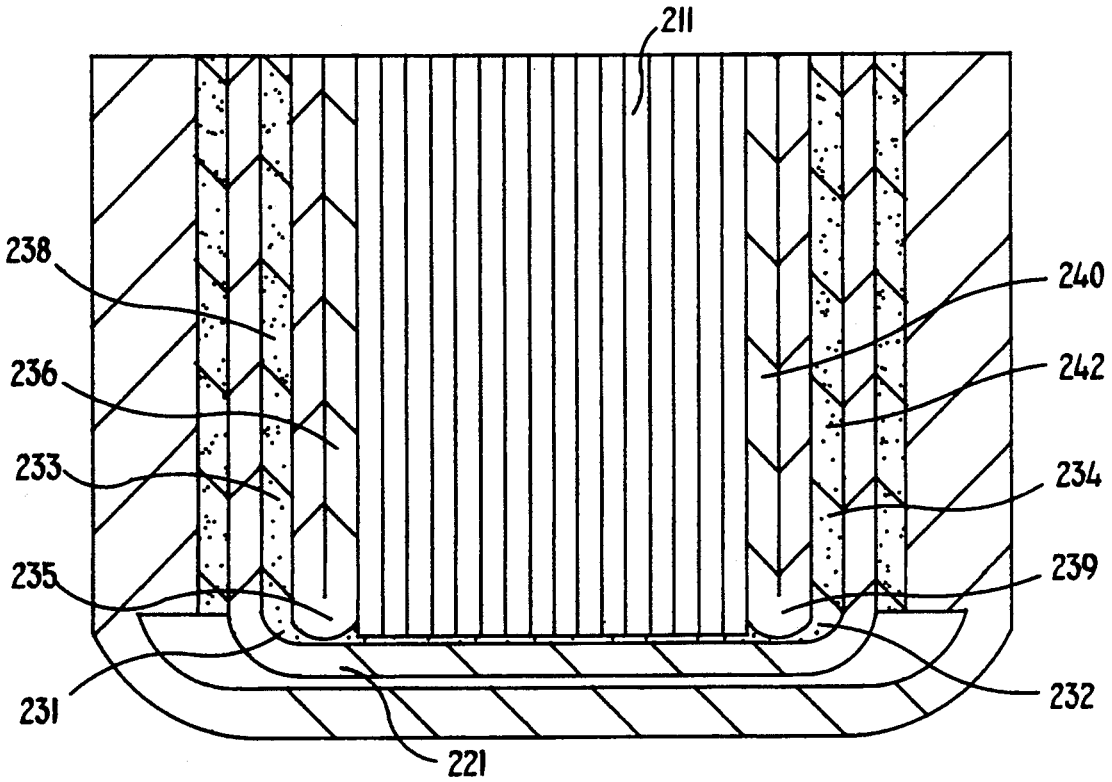
FIG. 18 is a diagrammatic view of the fourth stop in the second embodiment of the present invention.

Thus, as shown in FIG. 18, when the hot-melt has been softened, the excess expresses sideways into the void created by the fold 235 and between the fold 235 and the liner 221, and the void between the fold 239 and liner 221 and thereafter into the channels 233 and 234 where the excess portions 231 and 232 meet the adhesive layers 238 and 242. It should be noted that the flow of excess adhesive generally is minimal between the inner page 236 and the book block 111 and between the inner page 240 and the book block 111.

Figure 19:
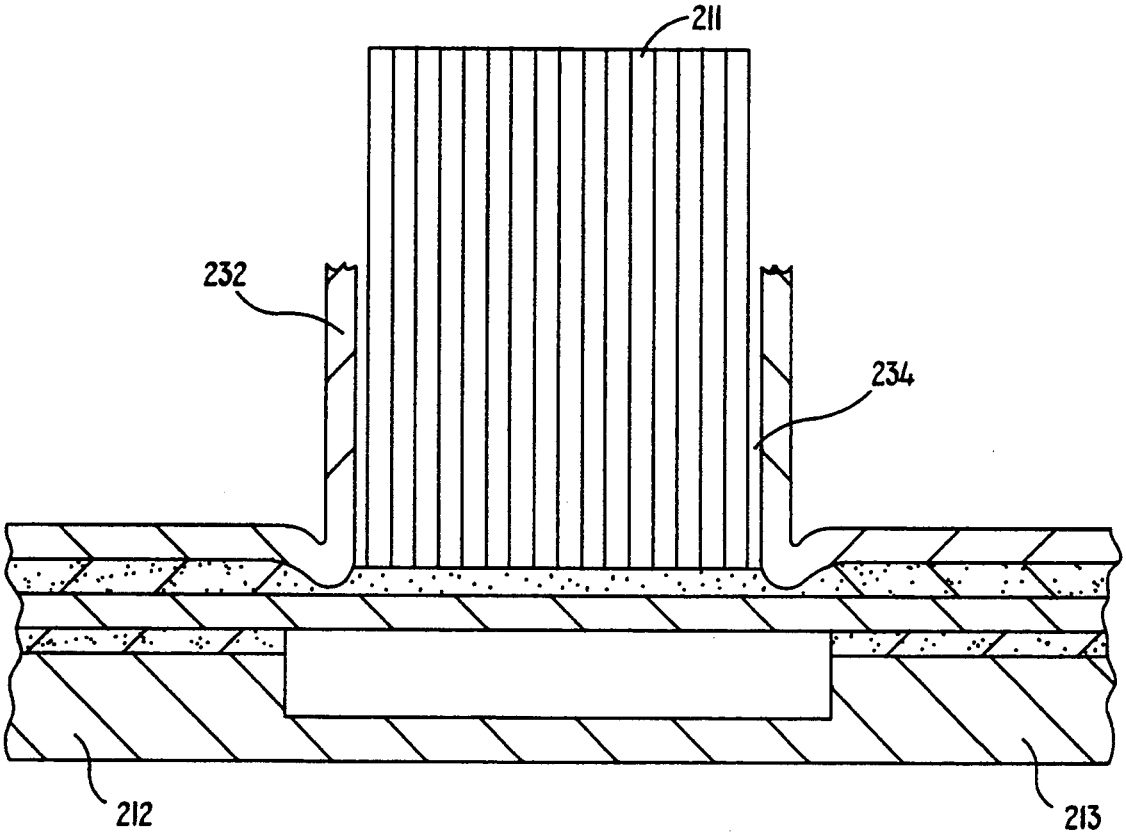
FIG. 19 is a diagrammatic view of the fifth step in the second embodiment of the present invention.

FIG. 19 shows the resulting product with the front cover 212 and rear cover 213 folded back. As can be seen, there is no adhesive bonding between the book block 211 and the front cover 212 or rear cover 213 so that the covers hinge freely. Once again, the diverting elements 232 and 234 have the appearance of traditional end papers although they do not function in the same way.

Figure 20:
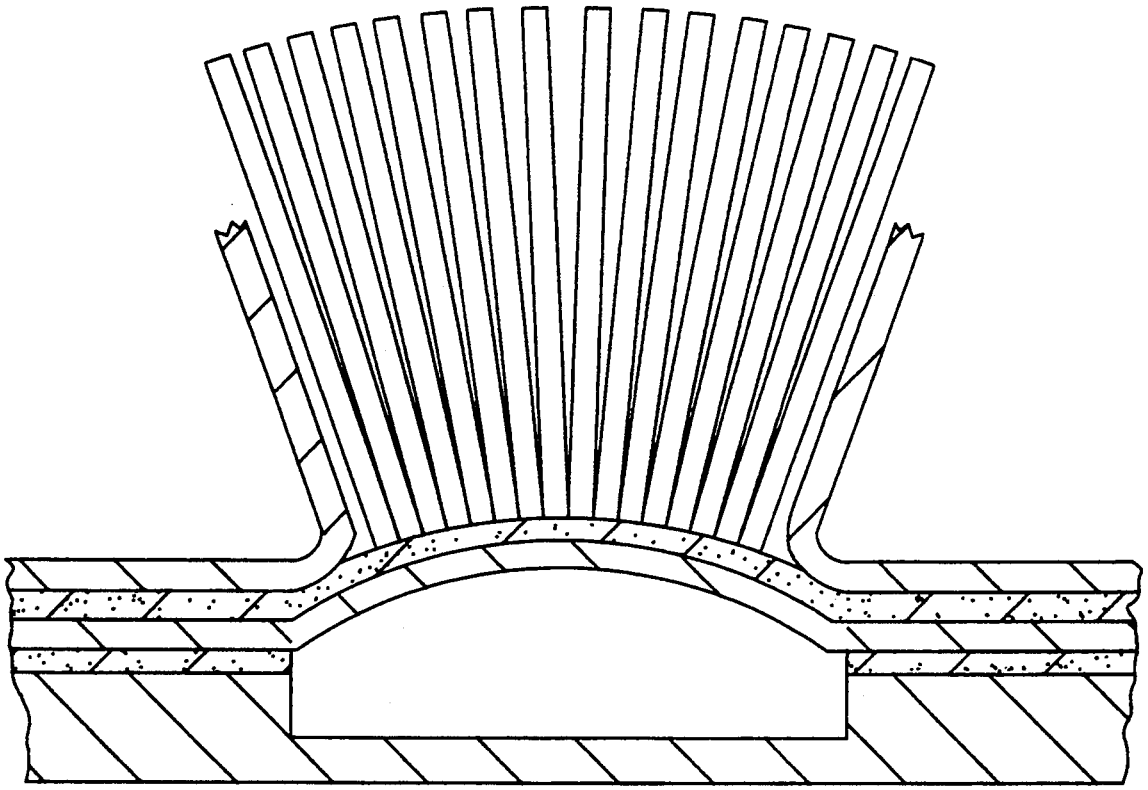
FIG. 20 is a diagrammatic view of the sixth step in the second embodiment of the present invention.
Figure 21:
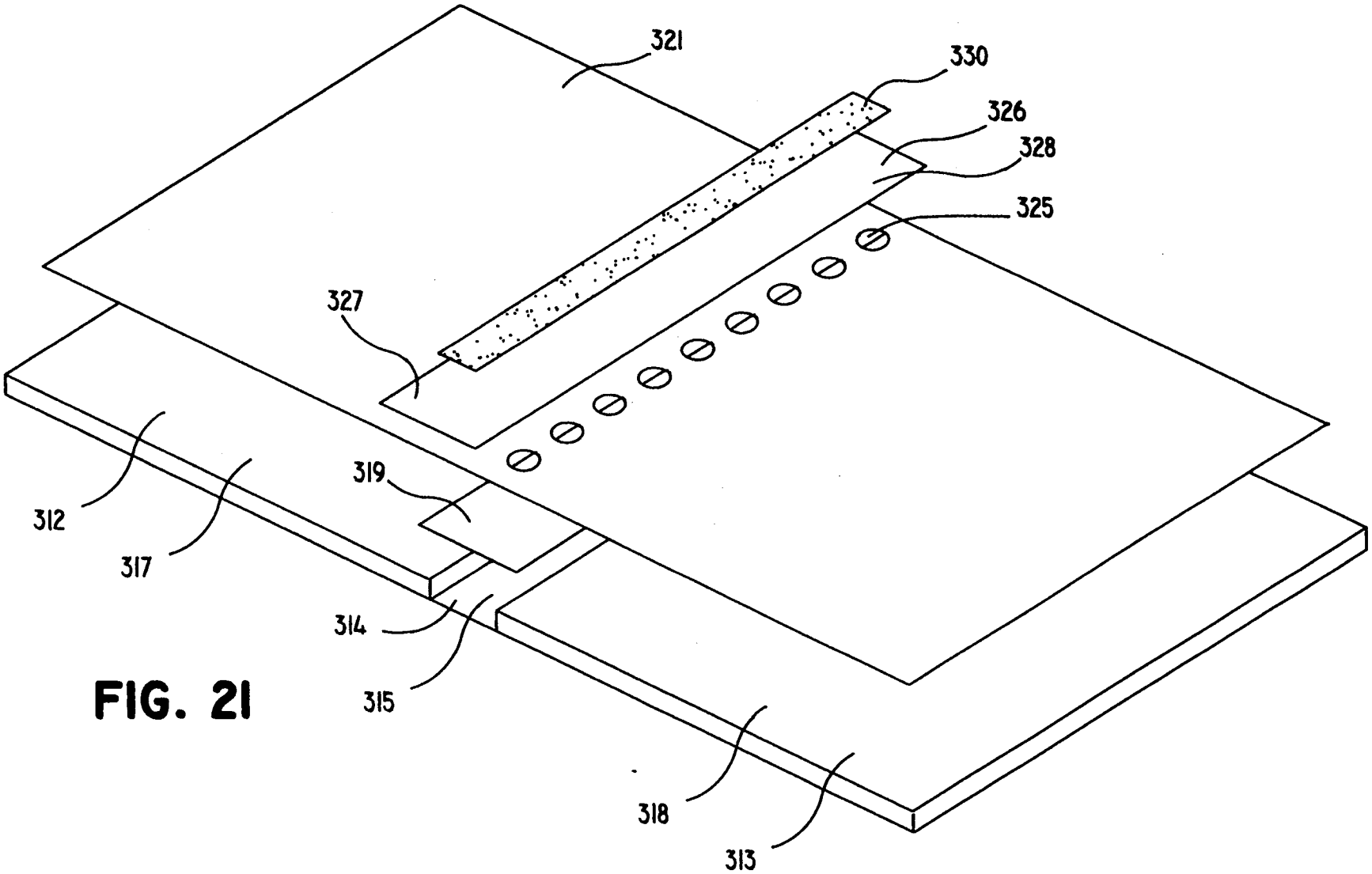
FIG. 21 is a perspective view in an exploded form to show the elements of the third embodiment of the present invention.

FIG. 20 shows the resulting product with the pages fanned to show the flexibility of the structure.

The above-described first and second embodiments of the present invention, while rendering an excellent product, are somewhat difficult to manufacture on high speed automated equipment. One significant problem is the application of adhesive to the folded end papers. Using automated equipment, the adhesive frequently curls up between the two pages as they pass through the nip rollers and therefore the two papers are sometimes glued together undesirably. While careful design and operation of the automated equipment can avoid this problem, such care is not always practical.

A third embodiment of the present invention is described below and described in FIGS. 21 through 27. This third embodiment provides a totally different hidden path for the hot-melt to dissipate itself.

Simply stated, the third version essentially provides a strip of thin, stiff saturated paper 326 which surrounds the sides of the zone of the hot-melt adhesive 330, when the case is closed, and essentially captures the excess hot-melt between itself and the first and last pages of the book block to be bound. The extreme edges of flaps 327 and 328 of the paper strip 326 will end up being bound against the book block 311 of the book, because the flaps act as the diverter and for adhesive flow channels with the book block. This alteration of the basic problem of excess adhesive flow essentially eliminates the unacceptable result which would otherwise occur if this same phenomena occurred between the inner surfaces of the covers and the pages to be bound. The feature to this third embodiment is that the saturated paper strip is adhesively bound down a narrow center strip through holes 335 in the liner 321 to a super-strong Tyvek-brand polymer web 319. The web 319 is itself adhesively bound to the inside surface 317 of the front cover 312 and the inside surface 318 of the rear cover 313. It bridges across the spine groove 315 but is not adhesively bound to the spine 314. This rather unusual structure creates a strong series of adhesively bound layers and thereby creates an unexpectedly strong total product.

Figure 22:
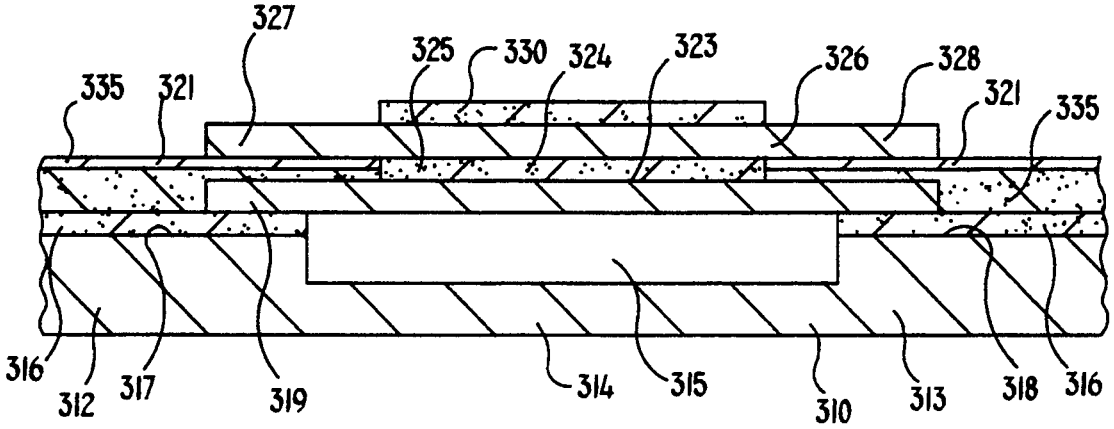
FIG. 22 is a diagrammatic view of the first step in the third embodiment of the present invention.

A diagrammatic presentation of the binding process employing the third embodiment of the present invention is set out in FIGS. 22 through 27. FIG. 22 shows a cross-sectional view of the spine section of the product as it would be purchased by the consumer before being used to bind pages. The case 310 includes the front cover 312, the rear cover 313 and the spine 314. The spine is flexible. It should be noted that there is a spine groove 315 which is formed over the spine 314. A layer of adhesive 316 covers the inside surface 317 of the front cover 312 and the inside surface 318 of the rear cover 313. The adhesive layer 316 bonds the high-strength flexible web 319 so that it bridges across the spine groove 315 along the entire length of the spine groove 315. The adhesive layers 316 and 335 also hold a liner 321 to the inside surface 317 of the front cover 312 and to the inside surface 318 of the rear cover 313. The liner 321 is also adhesively bonded to the inside surface 323 of the web 319 by means of the adhesive layer 335. Adhesive layers may be separate applications, may be a single layer of adhesive, and may be arranged in a number of arrangements. The liner 321 has a series of holes 325 along its center-line and the holes are positioned along the center line of the cover. The adhesive layer 324 extends through the holes. The portion of the adhesive layer 324 which extends through the holes 325 adhesively bonds the tape 326 to the web 319. Because the page tape 326 is bonded along the length of its central portion, the page tape 326 has longitudinal flaps 327 and 328 which extend to each side of the center line of the book. On the inside surface 329 of the page tape 326 is a body of hot-melt adhesive 330 which will be employed to hold the pages in the case 310.

Figure 23:
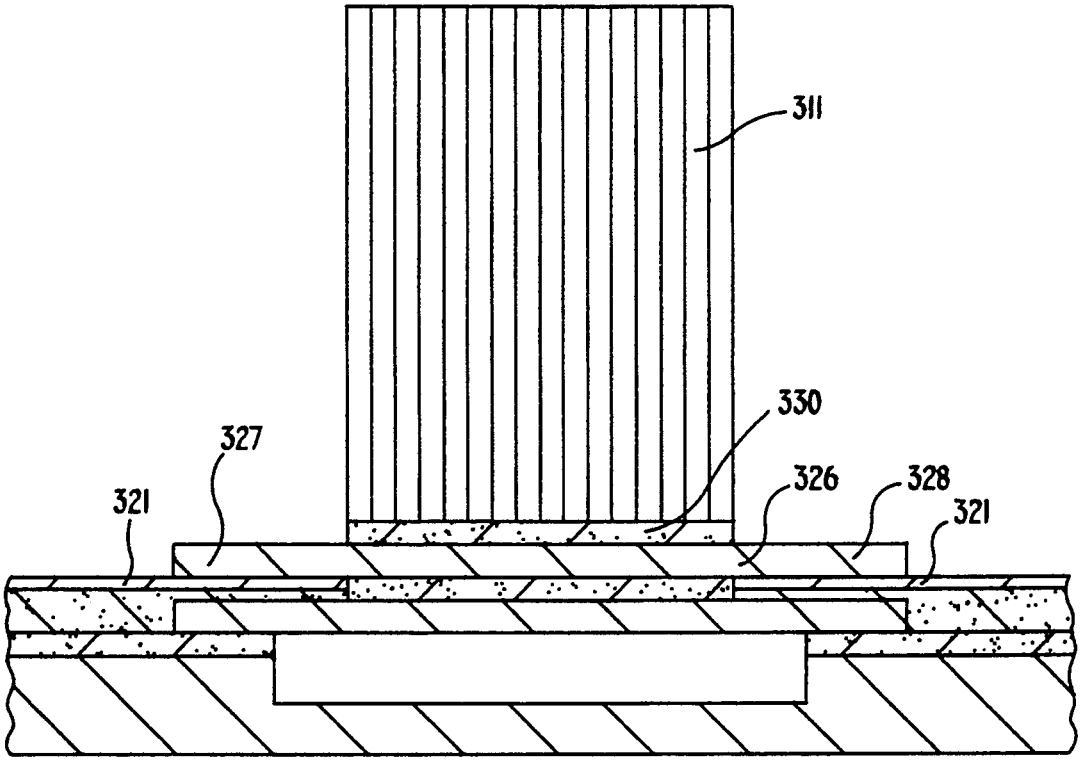
FIG. 23 is a diagrammatic view of the second step in the third embodiment of the present invention.

FIG. 23 shows the case 310 with the book block 311 stacked against the hot-melt strip 330.

Figure 2:
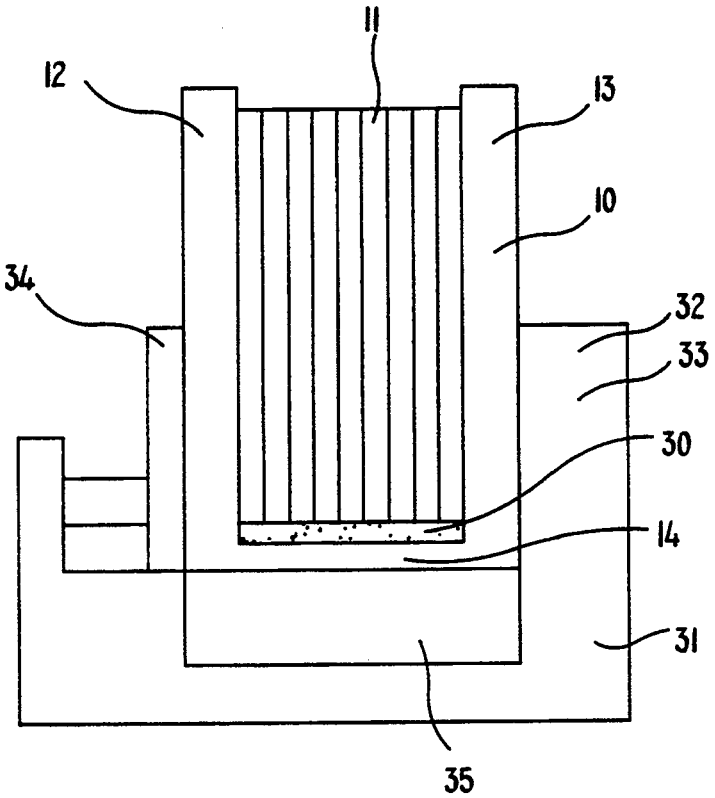
FIG. 2 PRIOR ART
FIG. 2 is a diagrammatic view of a prior art structure shown in a hot-melt binding device known the prior art.
Figure 3:
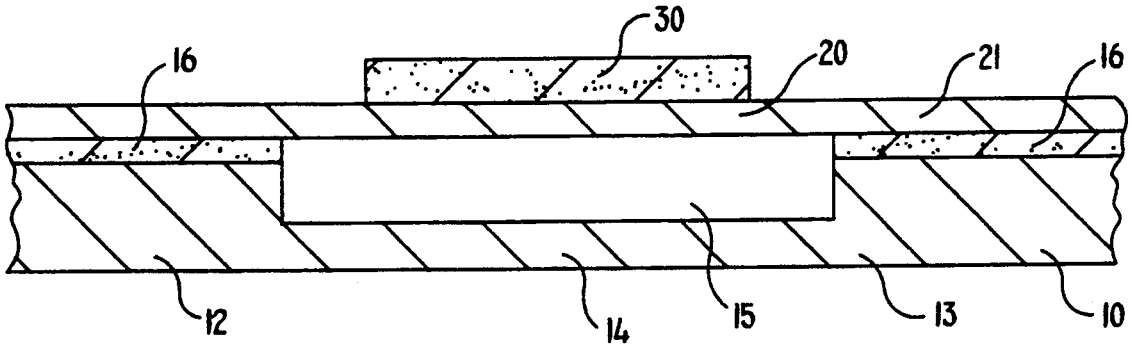
FIG. 3 PRIOR ART
FIG. 3 is a diagrammatic end view of the prior art structure shown in FIG. 1.
Figure 4:
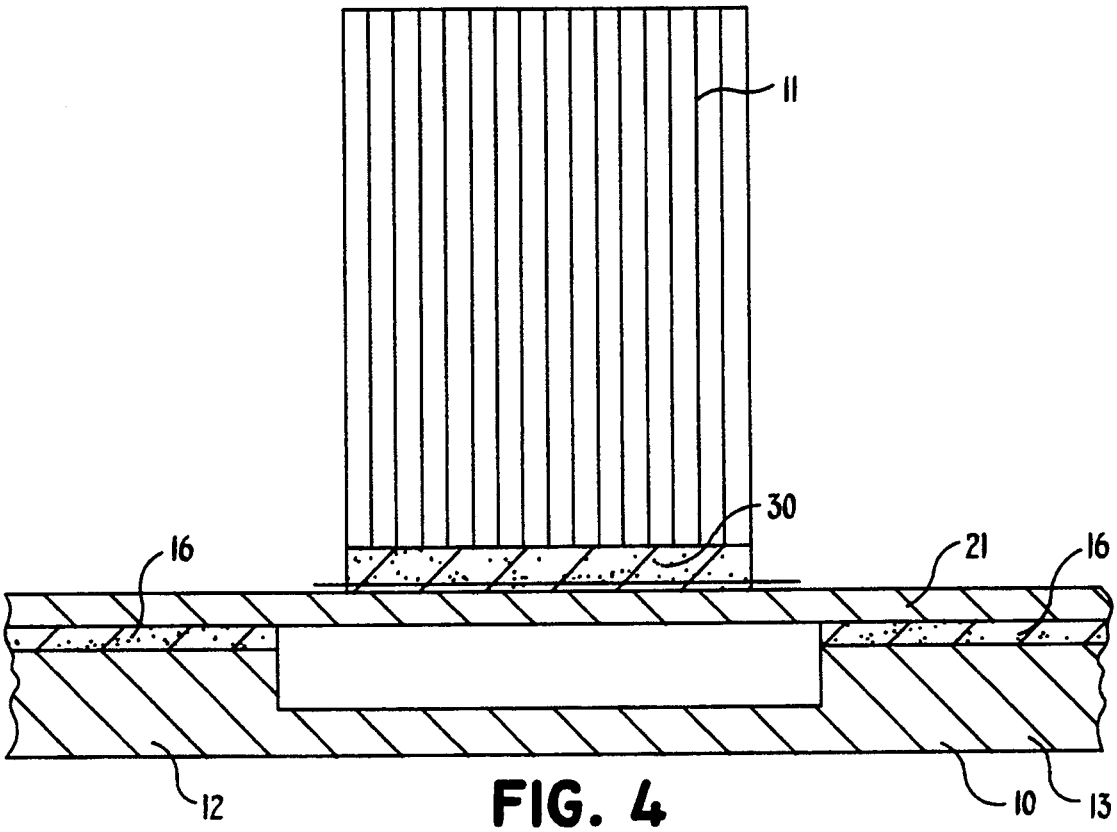
FIG. 4 PRIOR ART
FIG. 4 is a diagrammatic end view of the second step in the binding process employed on the shown in FIG. 3.
Figure 5:
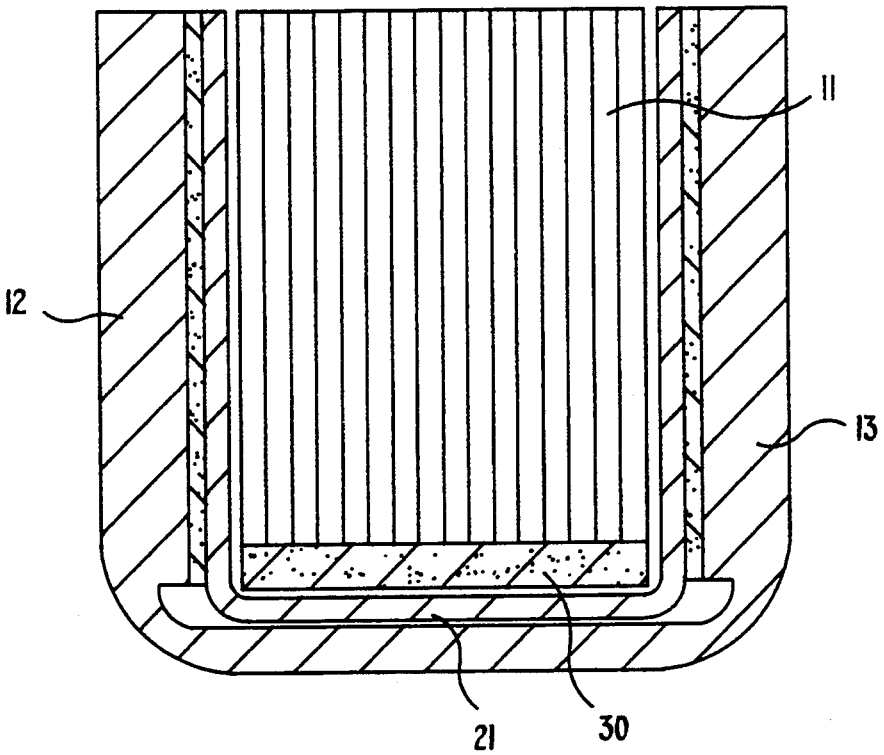
FIG. 5 PRIOR ART
FIG. 5 is a diagrammatic view of the prior art structure shown in FIG. 3.
Figure 6:
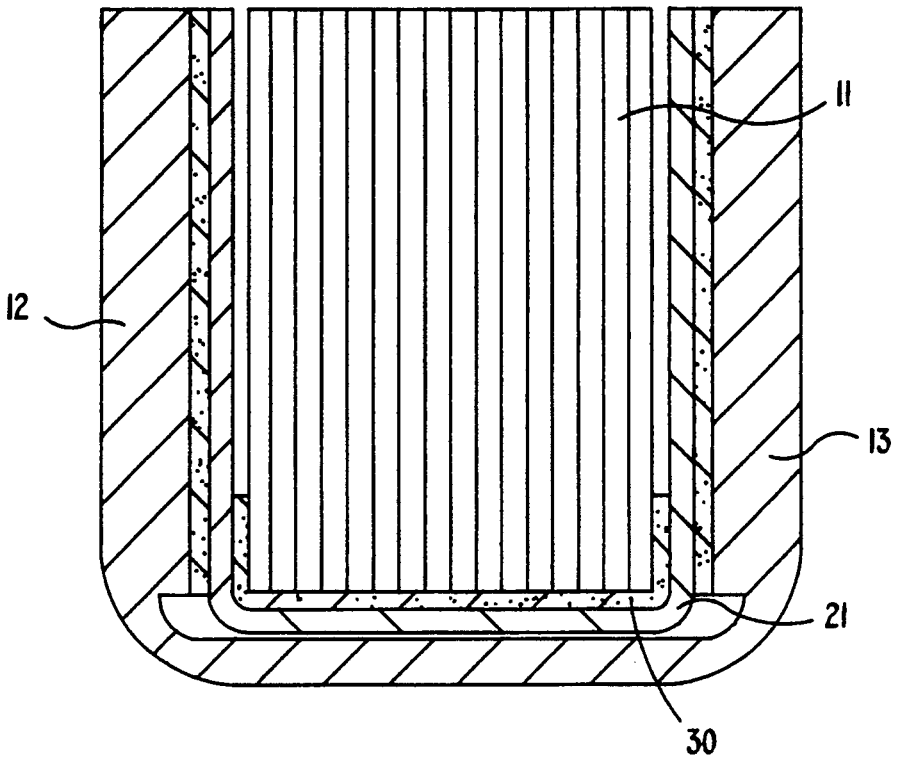
FIG. 6 PRIOR ART
FIG. 6 is a diagrammatic view of the prior art structure shown in FIG. 3 but shown after adhesive has formed.
Figure 7:
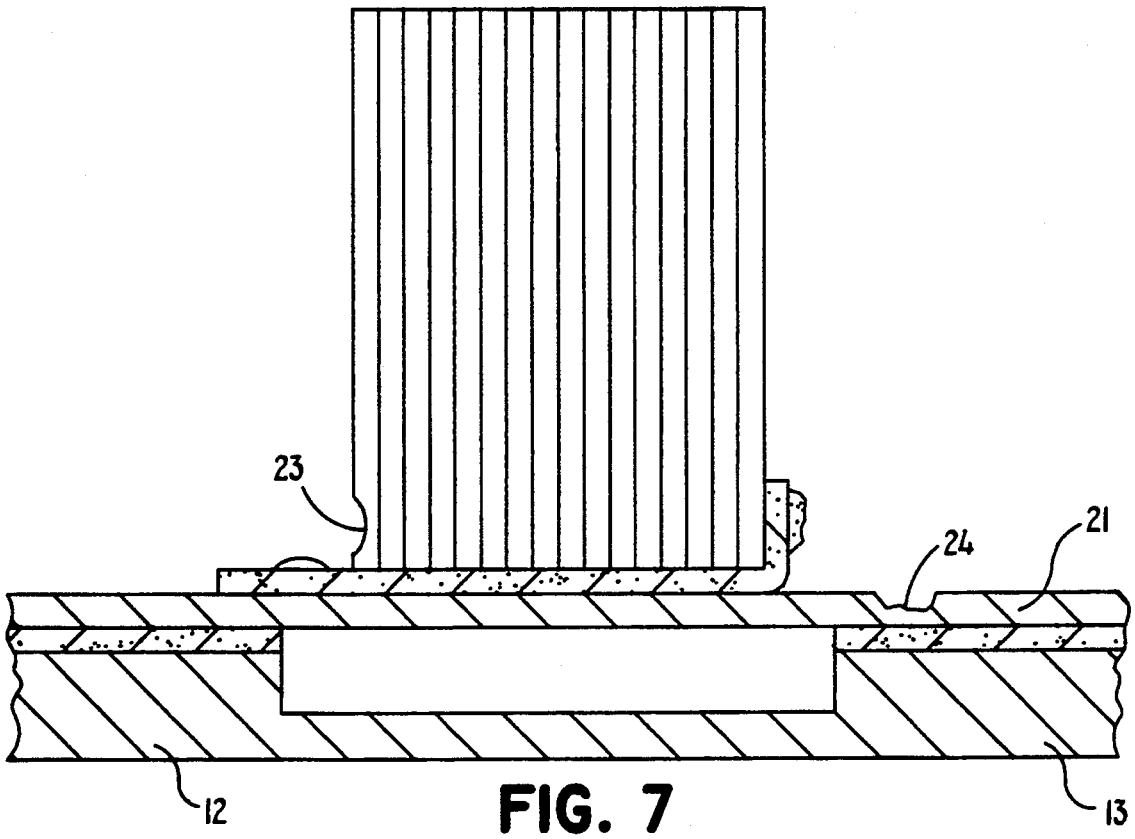
FIG. 7 PRIOR ART
FIG. 7 is a diagrammatic view of the structure shown in FIG. 3 but shows the destruction caused by the excess adhesive.
Figure 24:
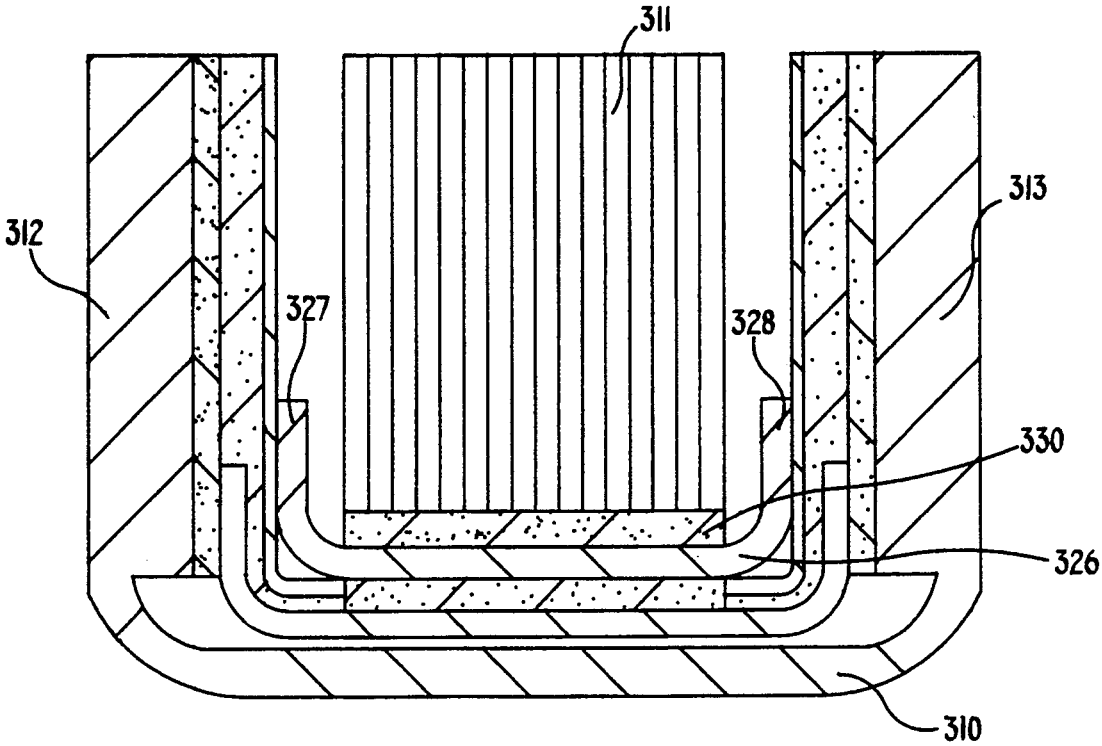
FIG. 24 is a diagrammatic view of the third step in the third embodiment of the present invention.

FIG. 24 shows the front and rear covers of the case 310 folded up against the book block as they would be positioned for insertion into the hot-melt binding machine similar to the representation in FIG. 2. This shows the hot-melt adhesive strip 330 prior to the melting operation.

Figure 25:
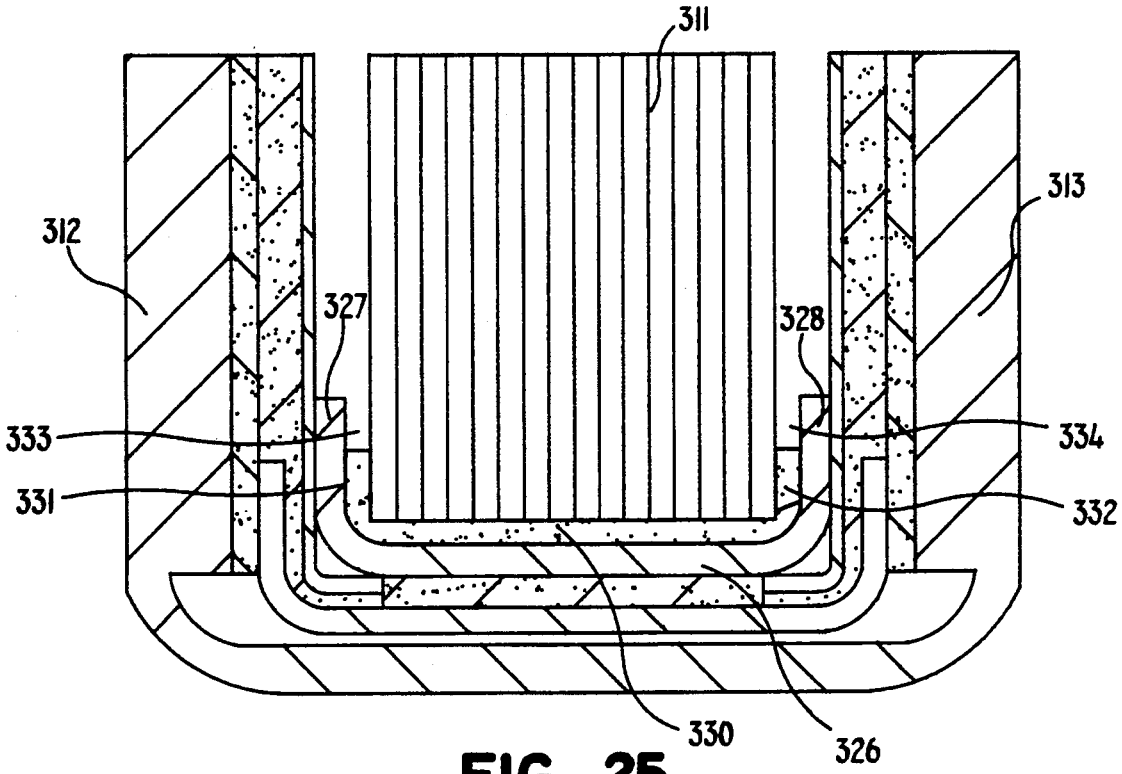
FIG. 25 is a diagrammatic view of the fourth step in the third embodiment of the present invention.

In FIG. 25, the hot-melt adhesive strip 330 is shown after the melting operation. The excess adhesive expresses sideways as portions 331 and 332 each following a channel 333 and 334 formed between the book block 311 and the front flap 327 and rear flap 328 of the page tape 326.

Figure 26:
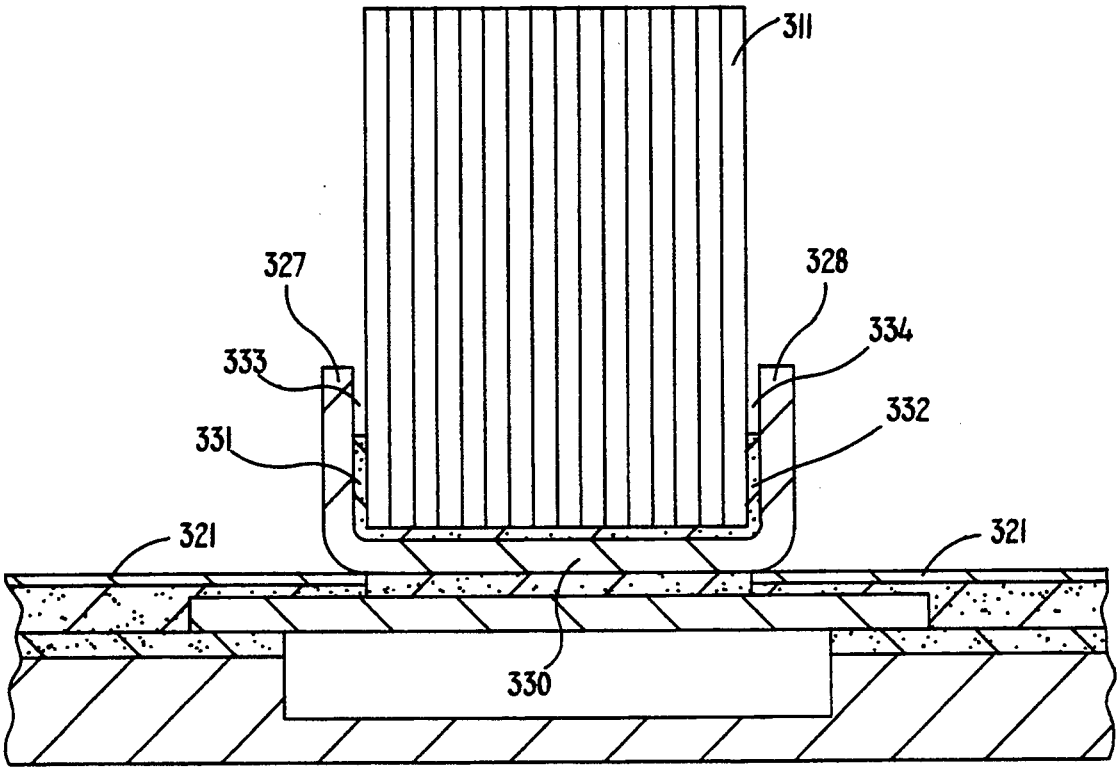
FIG. 26 is a diagrammatic view of the fifth step in the third embodiment of the present invention.

FIG. 26 shows the bound book block 311 and case 310 following the binding operation.

Figure 27:
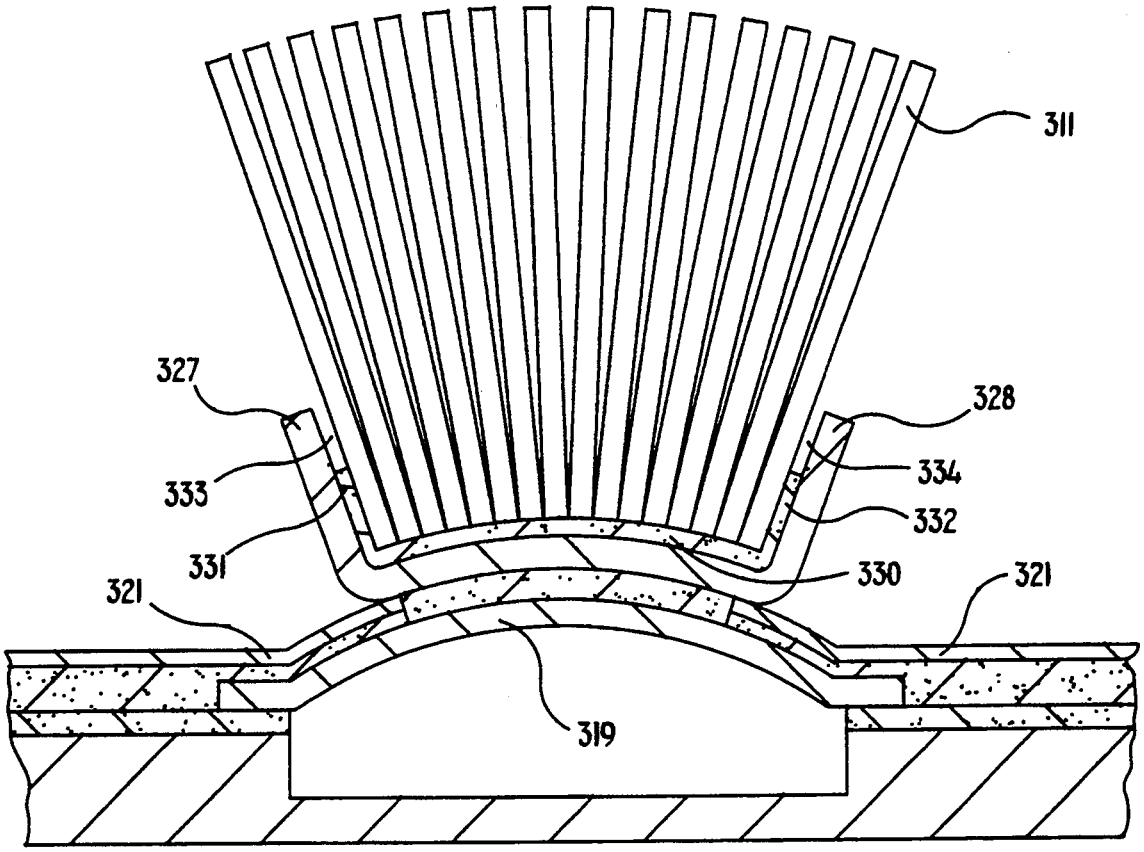
FIG. 27 is a diagrammatic view of the sixth step in the third embodiment of the present invention.
Figure 28:
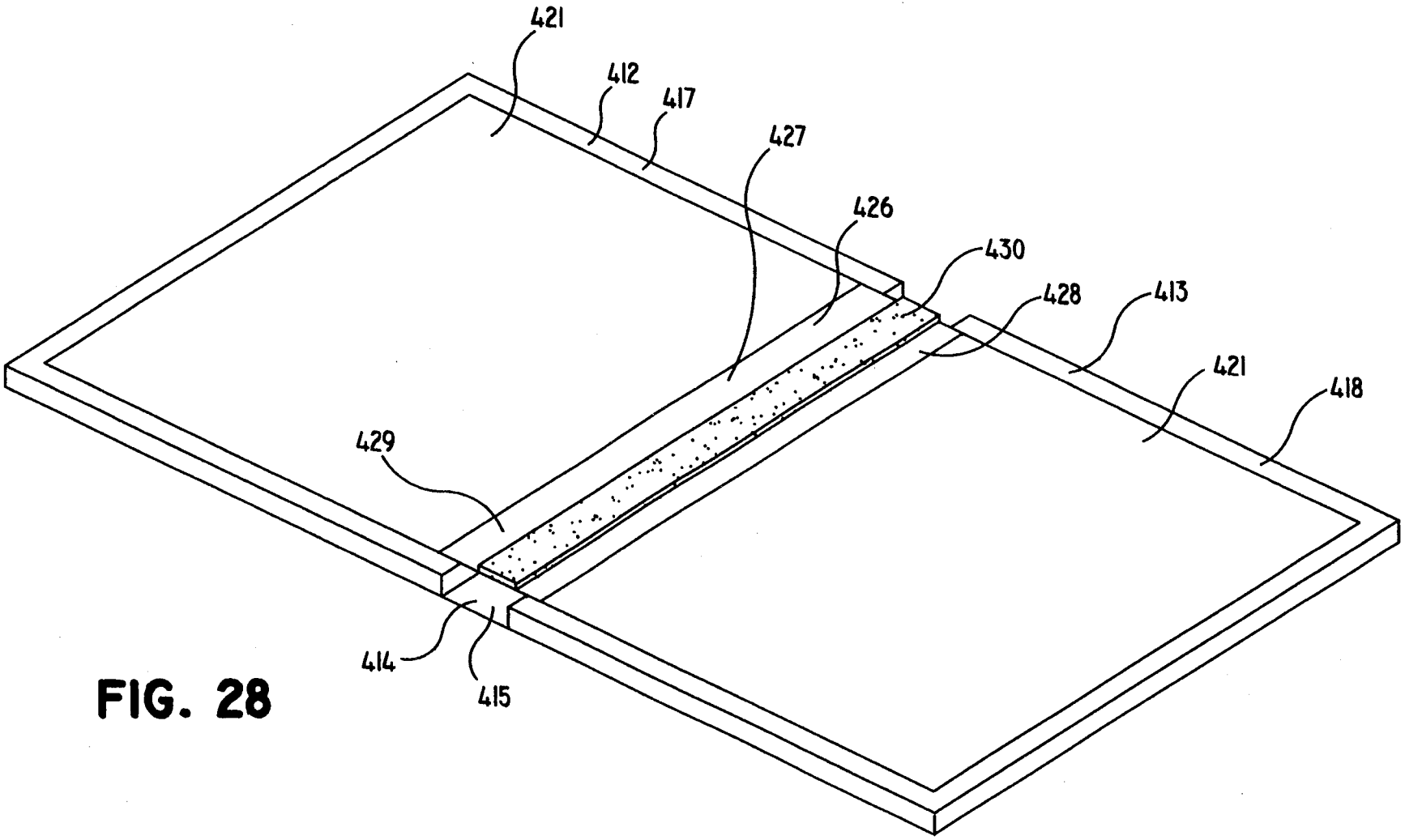
FIG. 28 is a perspective view of the fourth embodiment of the present the present invention.

FIG. 27 shows the bound product with the pages of the book block 311 fanned in order to show the flexibility and freedom of the book block from cover adhesion which freedom characterizes the present invention. The flexible structure of the hot-melt adhesive 330 and the spine web 319 allows the pages to fan abnd lie flat very effectively. Meanwhile the flaps 327 and 328 adhere to the outside pages of the book block 311 and hide the excess hot-melt adhesive, while presenting a neat and attractive appearance for the product in its final bound form.

It should be noted that the adhesive melts and attaches to the ends of the page but also excess adhesive is caused to flow upward between the flaps 327 and 328 and the front and back pages of the book block 311. The result is that the flaps 327 and 328 would be permanently bonded to the outside pages of the book block 331. However, because the flaps are long enough and are slightly stiff, the excess adhesive will not extend to the ends of the flaps and the slightly stiff flaps will stay adjacent the pages of the book block 311 so that the excess adhesive will be neatly hidden from view.

The fourth embodiment, as shown in FIGS. 28 through 34 is a simplified version of the third embodiment and is generally an appropriate choice when the significantly superior strength of the third embodiment is not necessary. Embodiment four might be appropriate when a relatively small number of pages are to be bound.

The fourth embodiment is very similar in appearance to the third embodiment in that it has a front cover 412 with an inner surface 417, a rear cover 413 with an inner surface 418, and both covers hingedly connected to a spine 414 which forms a spine groove 415. A liner 421 is adhesively bonded to the inside surfaces of the front and rear covers and bridges across the spine groove 415. A page tape 426 is adhesively bonded along its center portion, by a narrow adhesive strip 436, to the liner 421. The page tape 426 has non-bonded side flaps 427 and 428. A hot-melt strip 430 is adhesively bonded to the inside surface 429 of the page tape 426.

Figure 29:
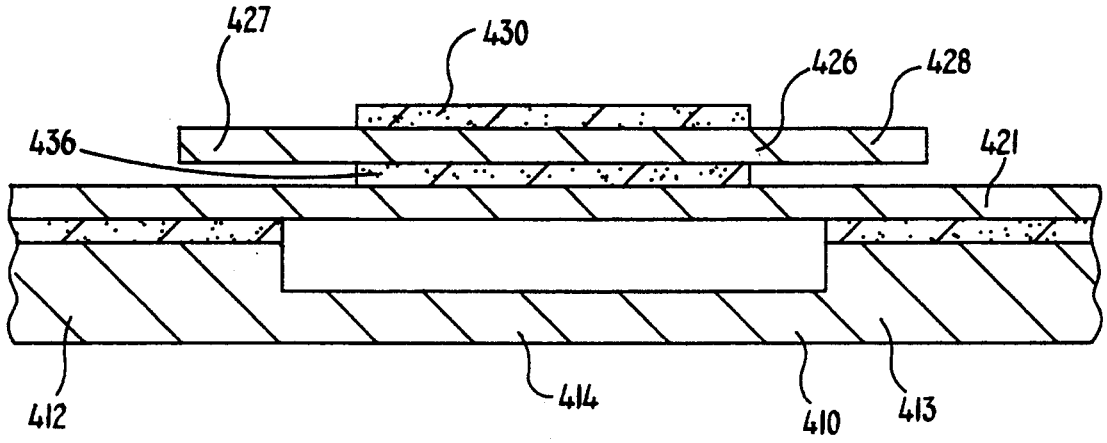
FIG. 29 is a diagrammatic view of the first step in the fourth embodiment of the present invention.

FIG. 29 shows the diagrammatic sectional view of the case 410 and shows how it is similar to but simpler than the third embodiment.

Figure 30:
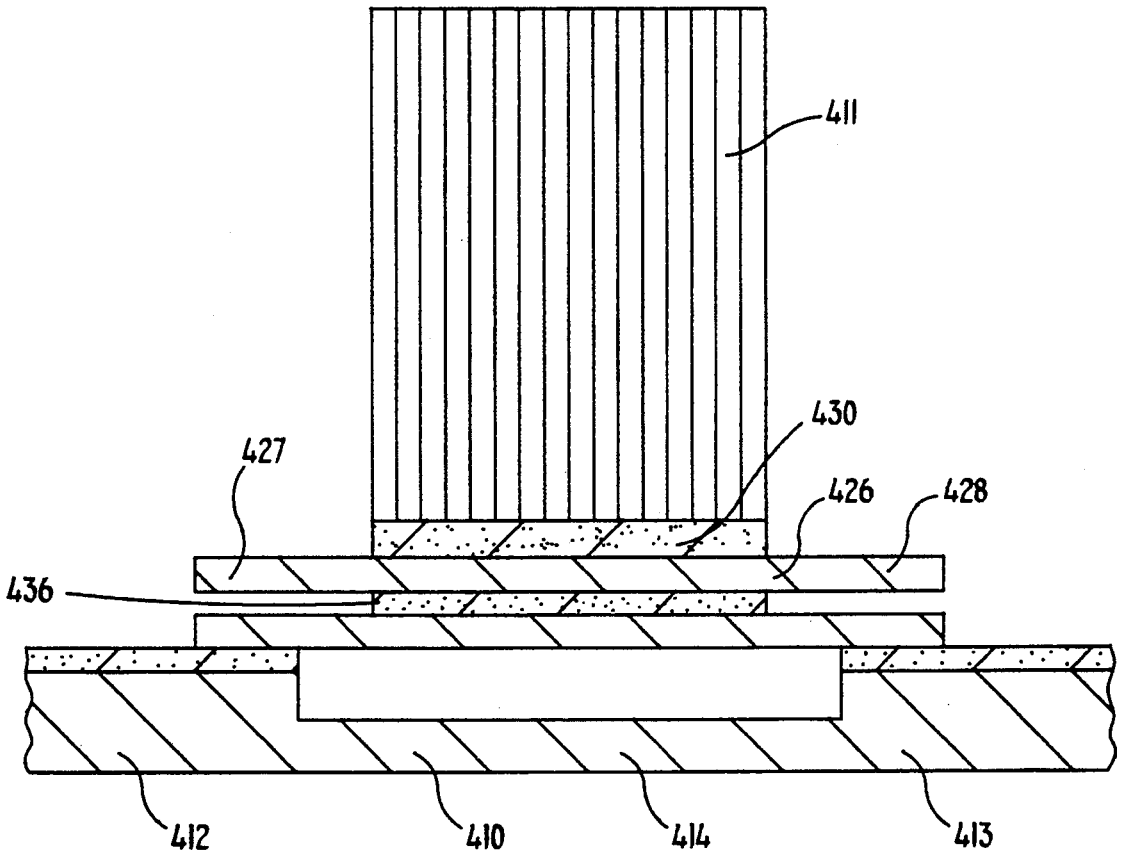
FIG. 30 is a diagrammatic view of the second step in the fourth embodiment of the present invention.

FIG. 30 shows the case 410 with the book block 411 positioned prior to the binding operation.

Figure 31:
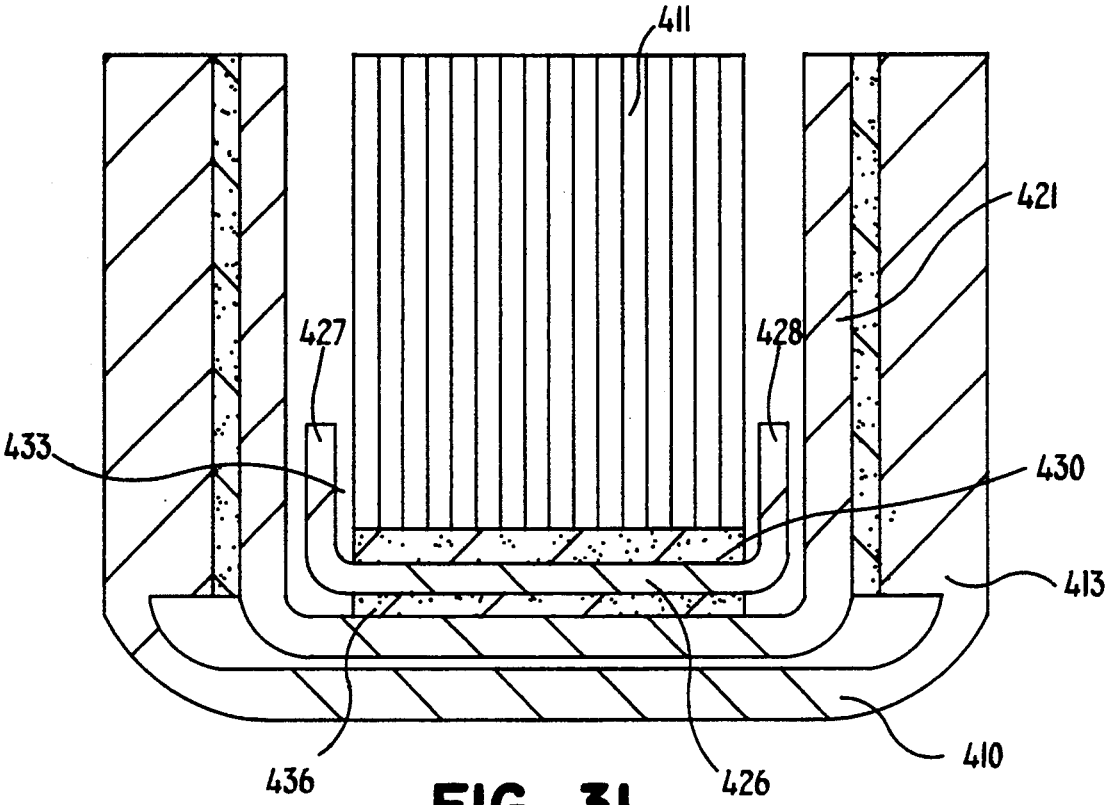
FIG. 31 is a diagrammatic view of the third step in the fourth embodiment of the present invention.

FIG. 31 shows the book block 411 with the covers folded up around the book block in preparation for binding. Once again, it is significant to note the manner in which the hot-melt strip 430 is surrounded by the flaps 427 and 428 of the page tape 426.

Figure 32:
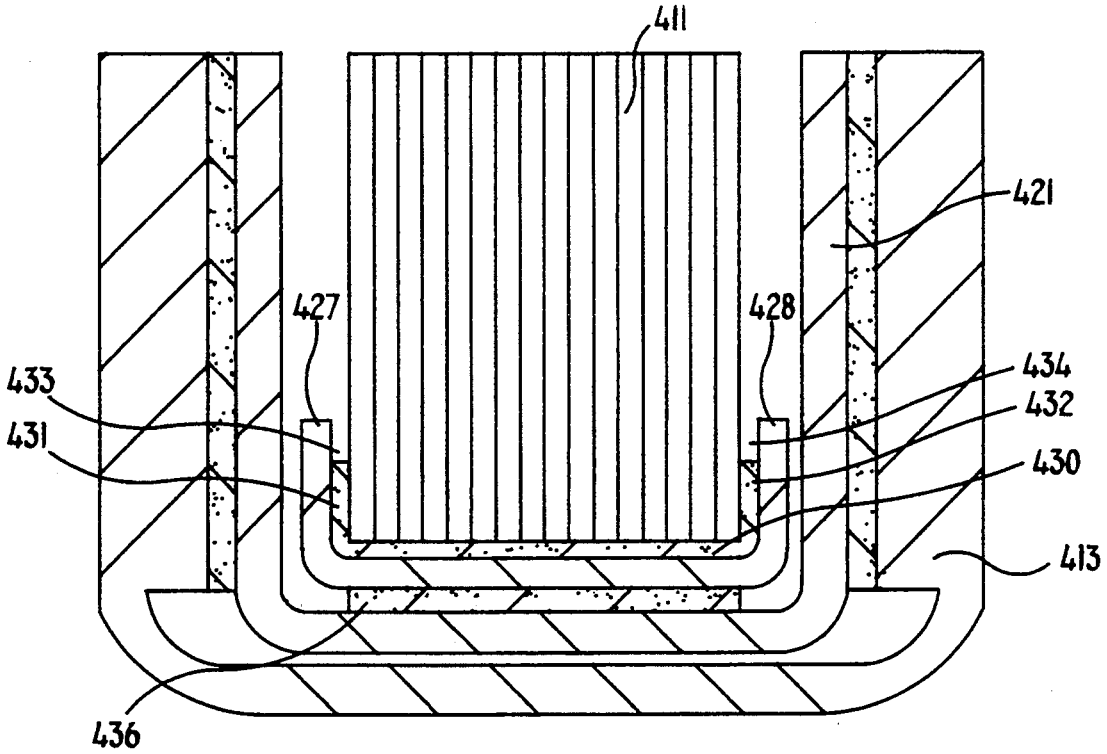
FIG. 32 is a diagrammatic view of the fourth step in the fourth embodiment of the present invention.

In FIG. 32, following the binding operation, the excess portions 431 and 432 of the adhesive are shown in the channels 433 and 434 formed between the book block pages and the flaps 427 and 428.

Figure 33:
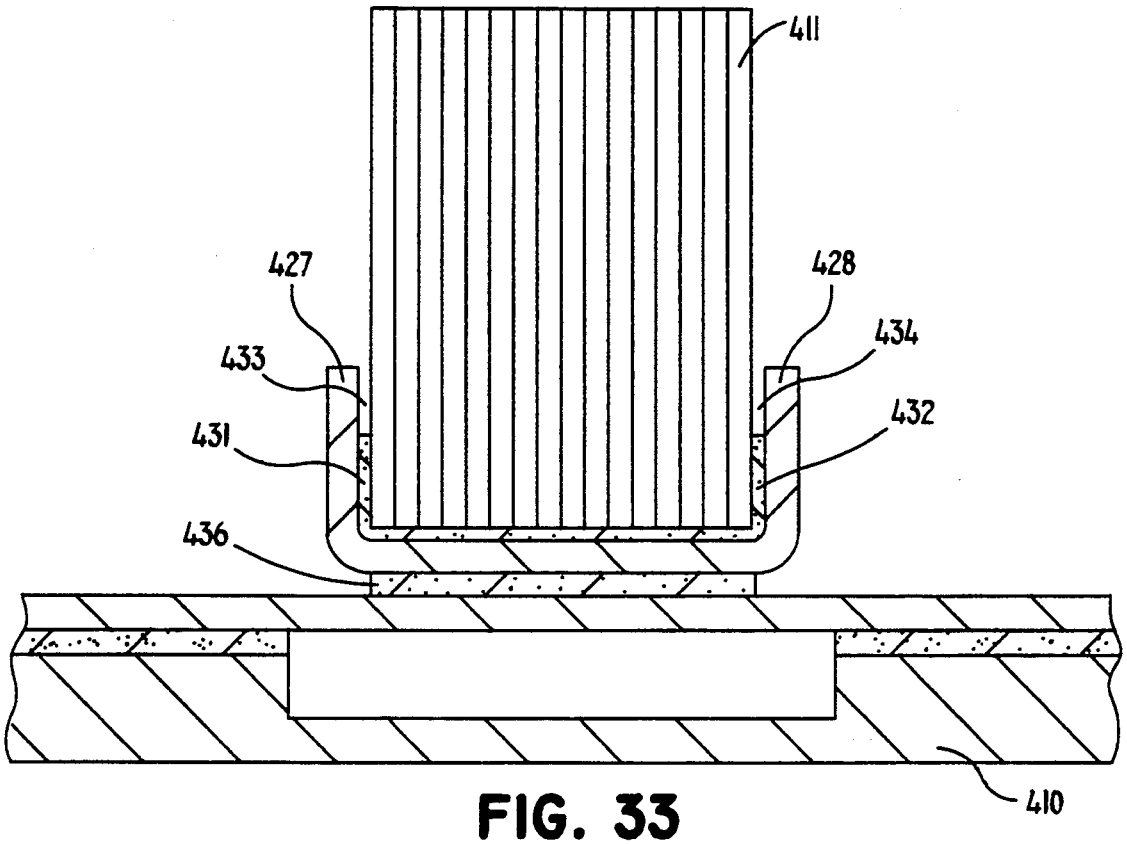
FIG. 33 is a diagrammatic view of the fifth step in the fourth embodiment of the present invention.
Figure 34:
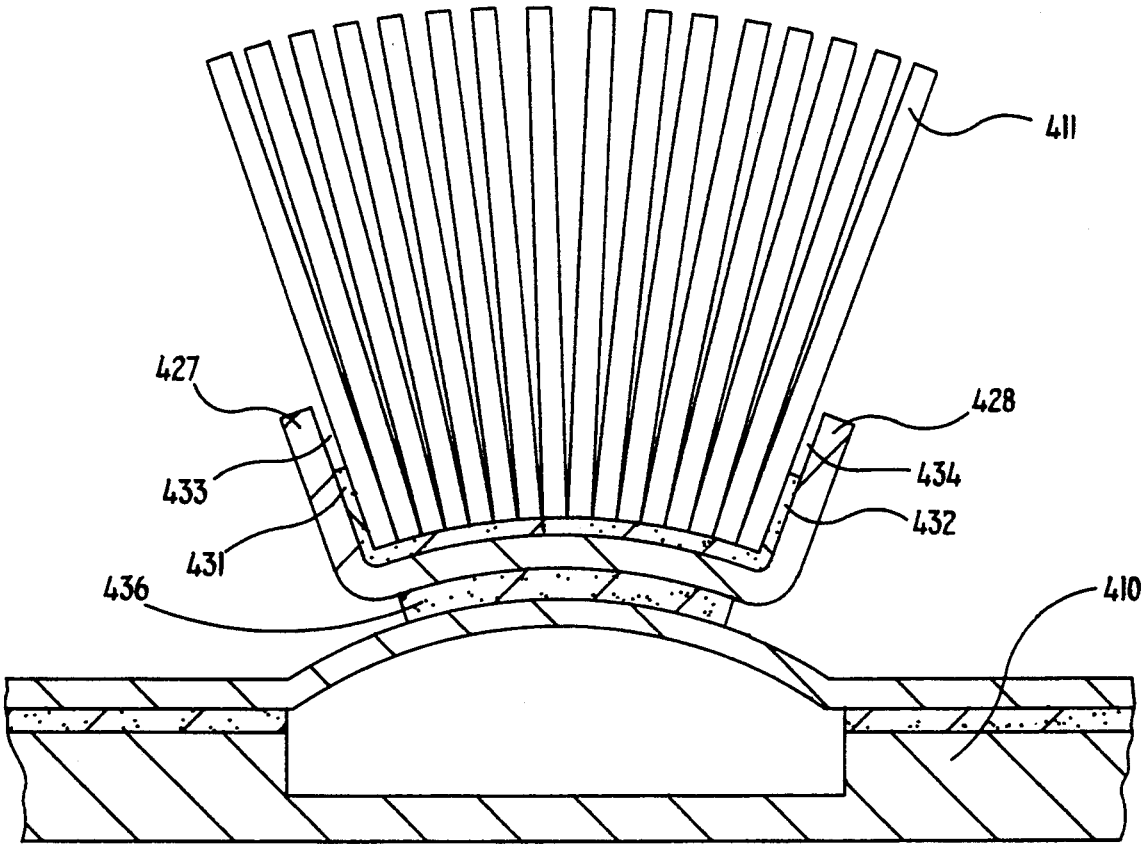
FIG. 34 is a diagrammatic view of the sixth step in the fourth embodiment of the present invention.
Figure 35:
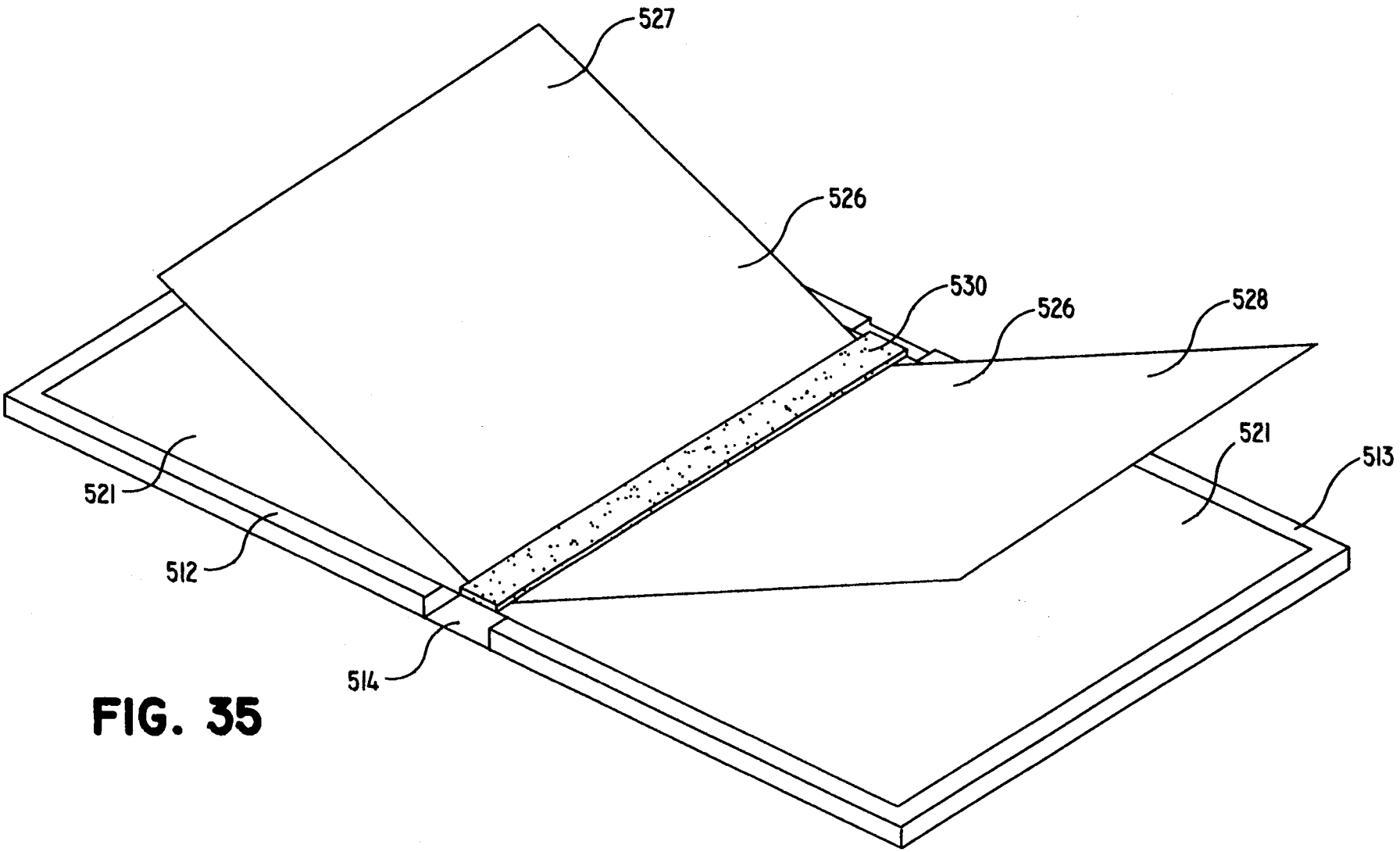
FIG. 35 is a perspective view of the fifth embodiment of the present invention.

In FIG. 33, the covers have been folded back and in FIG. 34, the pages have been fanned to show the flexibility of the product.

The fifth embodiment of the present invention is shown in FIGS. 35 through 41. Essentially the fifth embodiment is identical to the fourth embodiment except that the page tape 426 is replaced by a synthetic fly leaf or end leaf 526. The synthetic end leaf structure is adhesively bound between the liner 521 and the hot-melt strip 530, by narrow adhesive strip 536, and has end leaves 527 and 528 extending to each side of the hot-melt strip 530. Each of the end papers 527 and 528 are approximately the size of the pages of the book block 511 so that they have the appearance of conventional end leaves.

Figure 36:
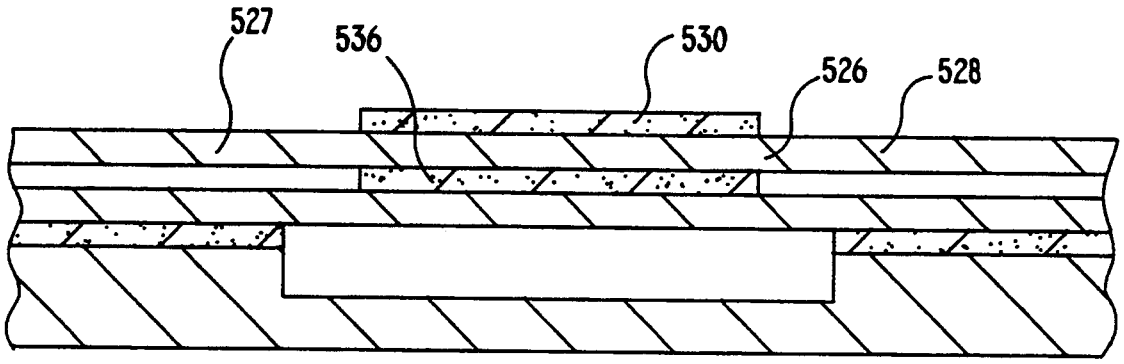
FIG. 36 is a diagrammatic view of the first step in the fifth embodiment of the present invention.

The binding operation performed on the fifth embodiment is very similar to that performed on the fourth embodiment. In FIG. 36, the case 510 is shown with the end papers 527 and 528 extending to each side of the hot-melt strip 530.

Figure 37:
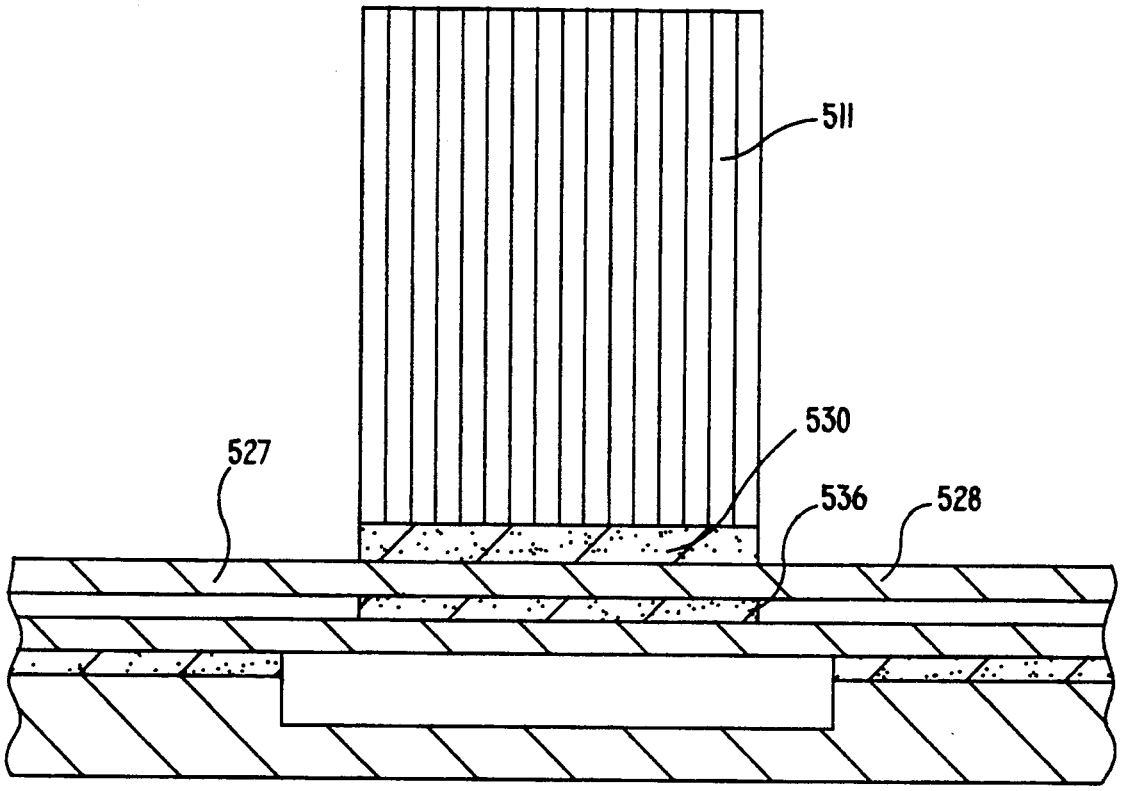
FIG. 37 is a diagrammatic view of the second step in the fifth embodiment of the present invention.

In FIG. 37, the book block 511 is stacked against the hot-melt strip 530.

Figure 38:
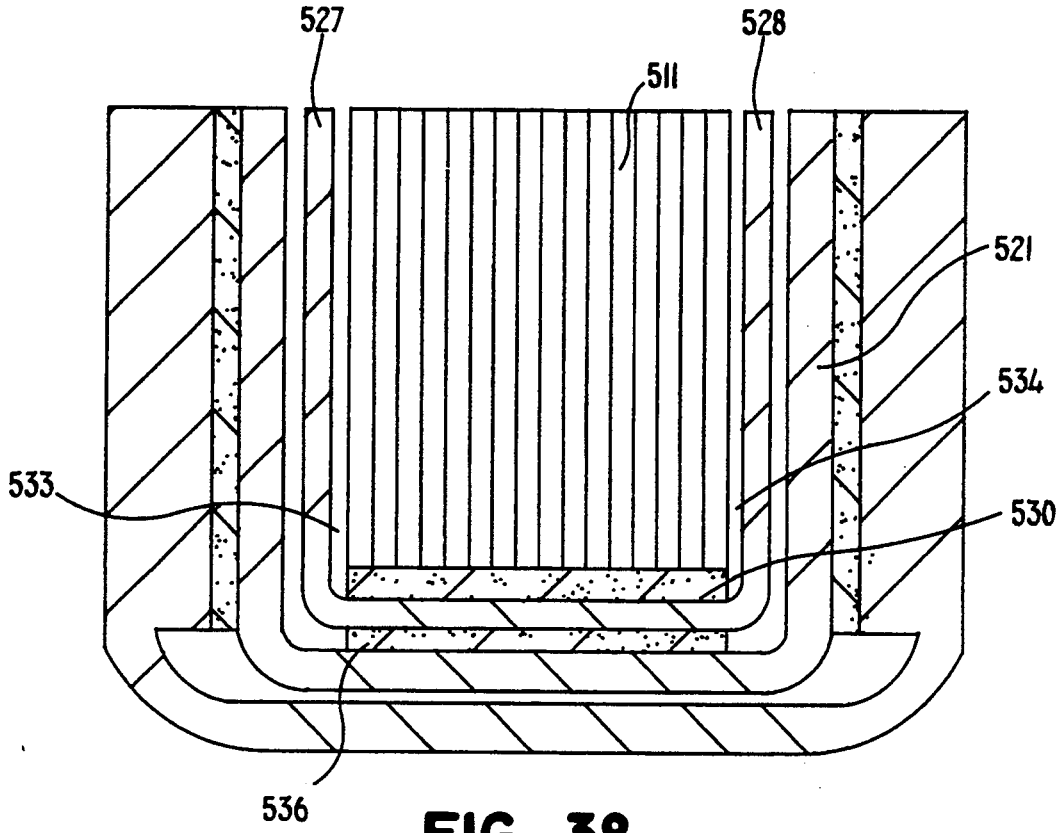
FIG. 38 is a diagrammatic view of the third step in the fifth embodiment of the present invention.

In FIG. 38, the covers 512 and 513 are folded up against the book block 511 and the device is placed in the binding machine.

Figure 39:
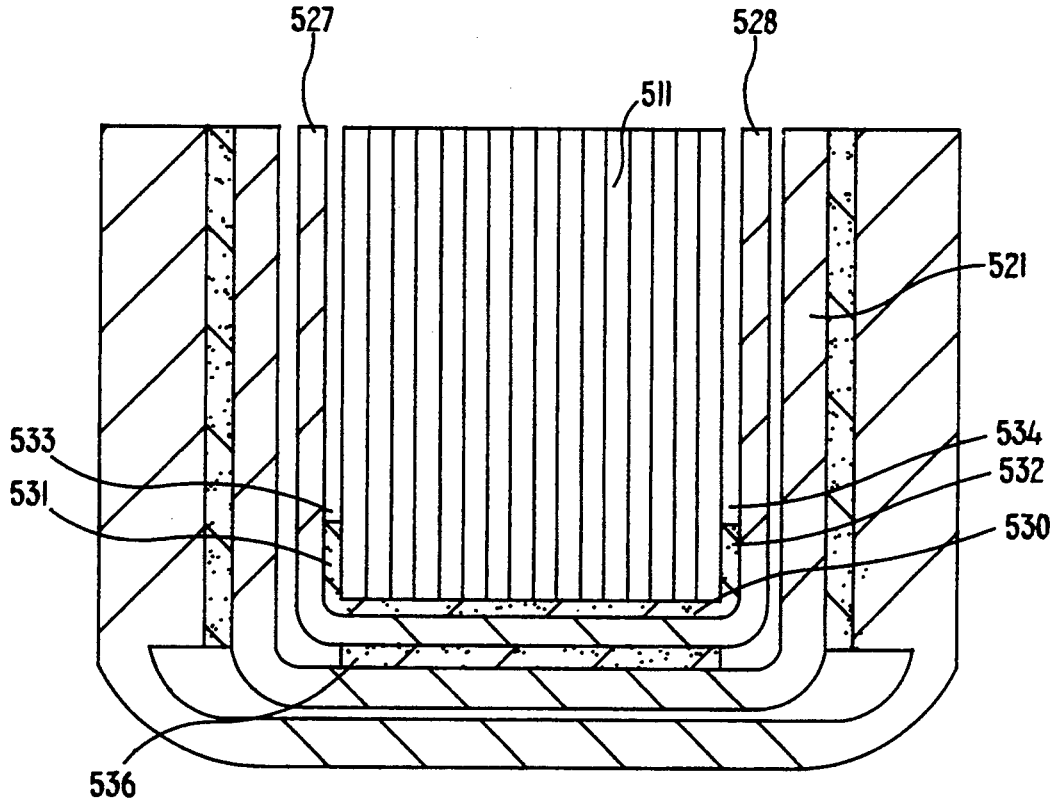
FIG. 39 is a diagrammatic view of the fourth step in the fifth embodiment of the present invention.

In FIG. 39, it is shown that the excess adhesive has expressed sideways as portions 531 and 532 in the channels 533 and 534 formed between the end papers 527 and 528 and the book block 511.

Figure 40:
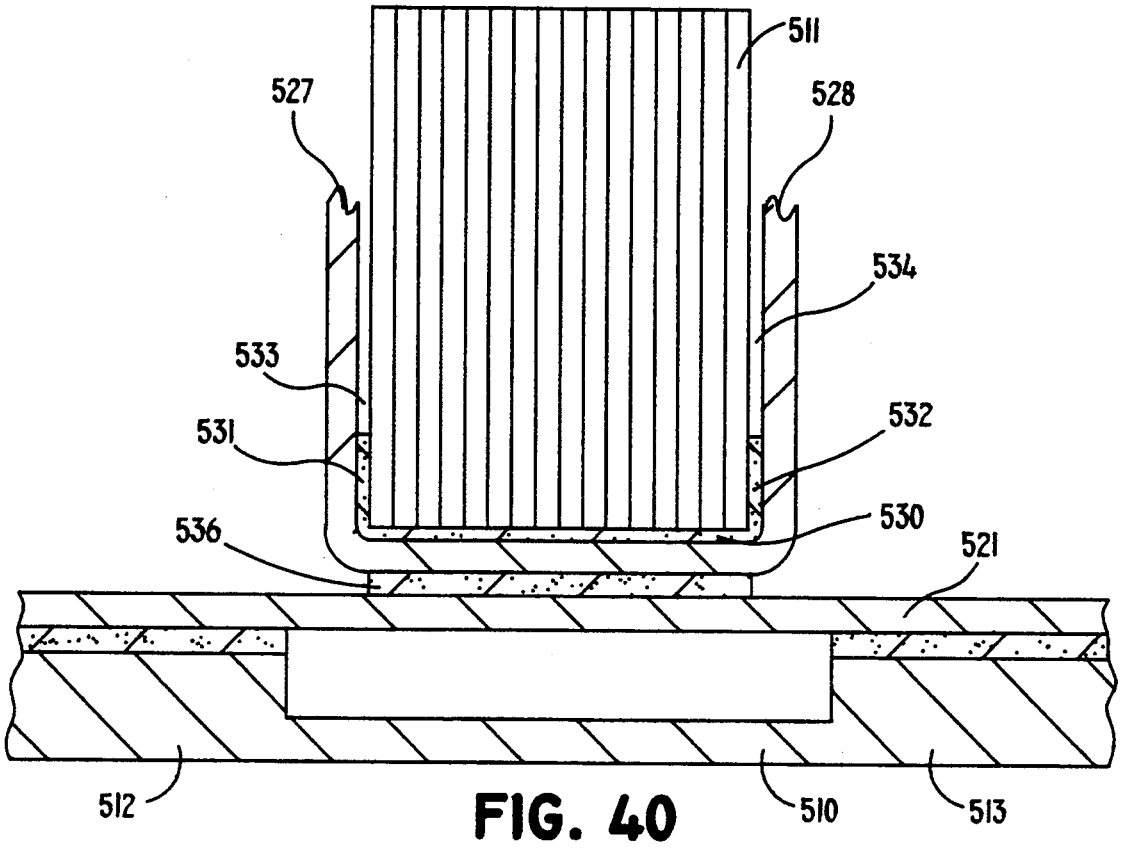
FIG. 40 is a diagrammatic view of the fifth step in the fifth embodiment of the present invention.
Figure 41:
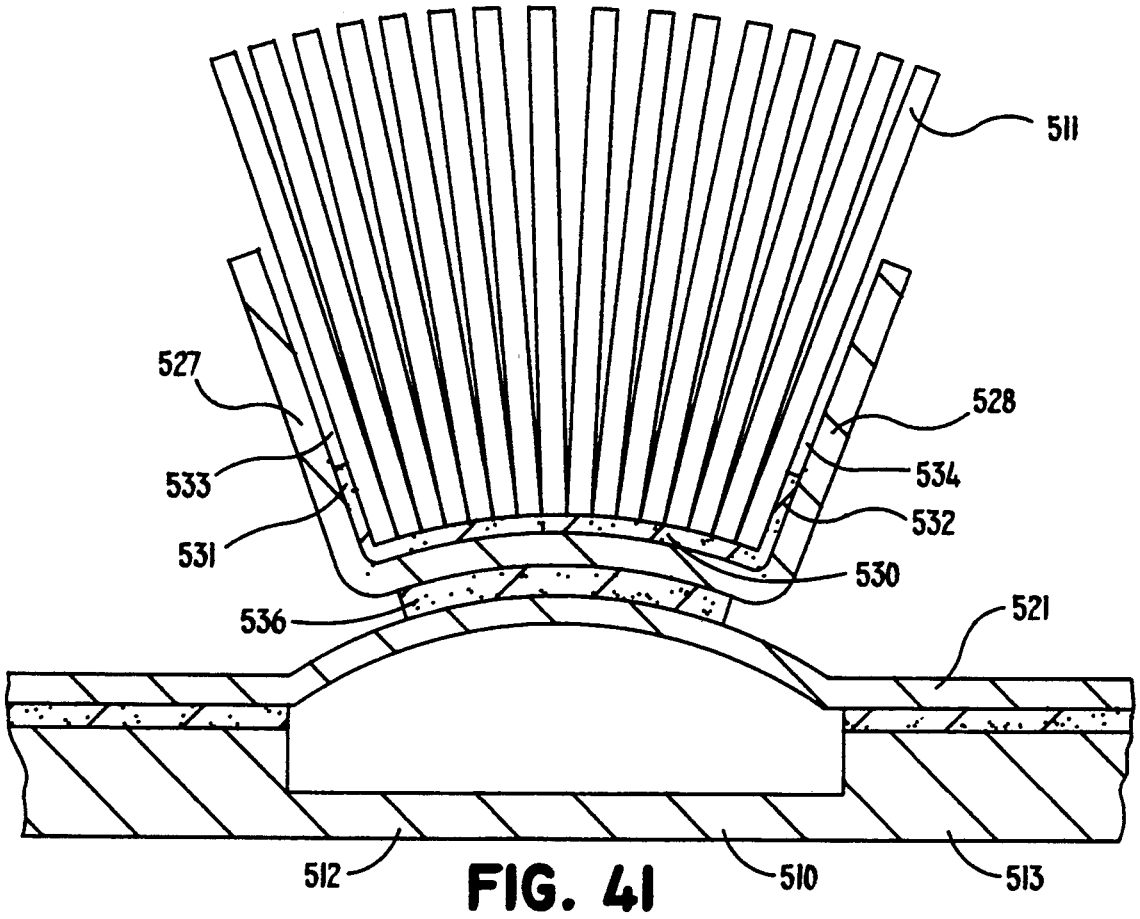
FIG. 41 is a diagrammatic view of the sixth step in the fifth embodiment of the present invention.

In FIG. 40, the bound and open product is shown with the end leaves 527 and 528 adhesively bound to the book block 511 in a manner which does not interfere with the hinge action of the covers 512 and 513. In FIG. 41, the pages are fanned in order to show the flexibility of this construction.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to be secured by Letters Patent is:

1. A case-bound hot-melt binding system, for desktop binding a book block of individual non-folded pages into a case, comprising:

(a) a case comprising (i) a spine, (ii) a front cover having an inner surface and hingedly mounted to the spine, (iii) a back cover having an inner surface and hingedly mounted to the spine, (b) a liner adhesively bound to the inside surface of the front cover and to the inside surface of the back cover, across the spine and free to move with respect to the spine, (c) a strip of hot melt adhesive mounted, at least indirectly, to the liner and opposite the spine, having two side edges that face the front and the back covers, and the adhesive being adapted to be softened and to adhere to all of the pages of the book block, said strip having the property that excess adhesive is sometimes expressed outwardly of the side edges of the strip, and (d) means, distinct from the pages, for diverting the excess adhesive so that the excess adhesive flows in such a way that the liner and covers hingedly move freely with respect to the pages, without damaging the liner or the pages, the diverting means comprising a folded end leaf having a first portion, a second portion and a folded edge, the folded edge separating the first portion from the second portion, the first portion being mounted on the liner, the folded edge being spaced apart from one of the sides of the strip of hot melt adhesive so that the second portion forms one side of a channel for the flow of excess adhesive.

2. A case-bound hot-melt binding system, for desktop binding a book block of individual non-folded pages into a case, comprising:

(a) a case comprising (i) a spine, (ii) a front cover having an inner surface and hingedly mounted to the spine, (iii) a back cover having an inner surface and hingedly mounted to the spine, (b) a liner adhesively bound to the inside surface of the front cover and to the inside surface of the back cover, across the spine and free to move with respect to the spine, (c) a strip of hot melt adhesive mounted, at least indirectly, to the liner and opposite the spine, having two side edges that face the front and the back covers, and the adhesive being adapted to be softened and to adhere to all of the pages of the book block, said strip having the property that excess adhesive is sometimes expressed outwardly of the side edges of the strip, and (d) means, distinct from the pages, for diverting the excess adhesive so that the excess adhesive flows in such a way that the liner and covers hingedly move freely with respect to the pages, without damaging the liner or the pages, the diverting means comprising a folded end leaf having a first portion, a second portion and a folded edge, the folded edge separating the first portion from the second portion, the first portion being mounted on the liner with a space formed between the liner and the first portion adjacent the folded edge, the folded edge being positioned relative to one of the sides of the strip of hot melt adhesive so that the space between the liner and the first portion forms a channel for the flow of excess adhesive.

3. A case-bound hot-melt binding system, for desktop binding a book block of individual non-folded pages into a case, comprising:

(a) a case comprising (i) a spine, (ii) a front cover having an inner surface and hingedly mounted to the spine, (iii) a back cover having an inner surface and hingedly mounted to the spine, (b) a liner adhesively bound to the inside surface of the front cover and to the inside surface of the back cover, across the spine and free to move with respect to the spine, (c) a strip of hot melt adhesive mounted, at least indirectly, to the liner and opposite the spine, having two side edges that face the front and the back covers, and the adhesive being adapted to be softened and to adhere to all of the pages of the book block, said strip having the property that excess adhesive is sometimes expressed outwardly of the side edges of the strip, and (d) means, distinct from the pages, for diverting the excess adhesive so that the excess adhesive flows in such a way that the liner and covers hingedly move freely with respect to the pages, without damaging the liner or the pages, the diverting means comprising a sheet of material attached between the strip and the liner, the sheet of material extending outwardly on each side edge of the strip to define a first outwardly extending portion and a second outwardly extending portion, the first outwardly extending portion and the front page of the book block forming a first adhesive diverting channel and the second outwardly extending portion and last page of the book block forming a second adhesive channel.

4. The case-bound hot-melt binding system as claimed in claim 3 wherein said sheet of material is appropriately sized to include a pair of end leaves, each of said end leaves being approximately the size of one of the pages of the book block.

5. A case-bound hot-melt binding system, for desktop binding a book block of individual non-folded pages into a case, comprising:

(a) a case comprising (i) a spine, (ii) a front cover having an inner surface and hingedly mounted to the spine, (iii) a back cover having an inner surface and hingedly mounted to the spine, (b) a high-strength flexible web mounted on the inside surface of the front cover and the inside surface of the back cover, across the spine and free to move with respect to the spine, (c) a liner adhesively mounted on the high-strength flexible web and the inside surfaces of the front cover and the rear cover, the liner having a plurality of openings positioned over the high-strength flexible web, (d) a strip of hot melt adhesive mounted, at least indirectly, to the liner and opposite the spine, the strip of hot melt adhesive having two side edges that face the front and the back covers, and the adhesive being adapted to be softened and to adhere to all of the pages of the book block, said strip having the property that excess adhesive is sometimes expressed outwardly of the side edges of the strip, and (e) a strip of paper adhesively attached to the high-strength flexible web through the openings in the liner, the sheet of paper extending outwardly on each side edge of the strip to define a first outwardly extending portion and a second outwardly extending portion, the first outwardly extending portion and the front page of the book block forming a first adhesive diverting channel and the second outwardly extending portion and last page of the book block forming a second adhesive channel.

* * * * *